US006385136B2

(12) United States Patent
Higuchi et al.

(10) Patent No.: US 6,385,136 B2
(45) Date of Patent: May 7, 2002

(54) ELECTRONIC TIMEPIECE WITH CALENDAR MONTH-END NON-CORRECTION DEVICE

(75) Inventors: Haruhiko Higuchi, Tokorozawa; Takeo Mutoh, Nerima-ku; Yasuo Kitajima, Sayama; Hiroyuki Koike, Nerima-ku, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/848,974

(22) Filed: May 4, 2001

Related U.S. Application Data

(62) Division of application No. 09/380,133, filed on Aug. 25, 1999.

(30) Foreign Application Priority Data

Dec. 26, 1997 (JP) ..... 9-359758
Jan. 9, 1998 (JP) ..... 10-2833

(51) Int. Cl.[7] ..... G04B 19/27
(52) U.S. Cl. ..... 368/28; 368/37

(58) Field of Search ..... 368/28–37

(56) References Cited

U.S. PATENT DOCUMENTS 4,695,168 A 9/1987 Meister et al.
4,733,384 A 3/1988 Meister et al.
5,270,993 A * 12/1993 Besson et al.
5,305,289 A * 4/1994 Besson et al.

* cited by examiner

*Primary Examiner*—Bernard Roskoski
(74) *Attorney, Agent, or Firm*—Koda & Androlia

(57) ABSTRACT

An electronic timepiece is provided with a device for automatically adjusting month-end calendar dates capable of reading dates simply, quickly, and reliably.

A date detection pattern 71 composed of reflective and non-reflective sections is formed on the rear surface of a date dial 70. When the date dial 70 rotates, a change in the boundary between the reflective part and the non-reflective part is read by a photo sensor 81, the necessary number of dates is determined by a control circuit 20 by use of a perpetual calendar circuit, driving a date dial driving mechanisms 51 and 52.

13 Claims, 23 Drawing Sheets

(a)

(b)

| DIREC-TION | DETECTION DATE | EDGE DETECT COUNT | | PATTERN |
|---|---|---|---|---|
| | | POSITIVE | NEGATIVE | |
| FORWARD ROTATION | 28 - 29 | 1 | 2 | PATTERN 1 |
| | 29 - 30 | 1 | 0 | PATTERN 2 |
| | 30 - 31 | 0 | 1 | PATTERN 3 |
| | 31 - 1 | 2 | 1 | PATTERN 4 |
| REVERSE ROTATION | 1 - 31 | 1 | 2 | PATTERN 5 |
| | 31 - 30 | 1 | 0 | PATTERN 6 |
| | 30 - 29 | 0 | 1 | PATTERN 7 |
| | 29 - 28 | 2 | 1 | PATTERN 8 |
| FORWARD/ REVERSE | DATES OTHER THAN ABOVE | 1 | 1 | PATTERN 9 |

ELECTRONIC TIMEPIECE WITH CALENDAR MONTH-END NON-CORRECTION DEVICE

This is a Divisional Application of application Ser. No. 09/380,133, filed Aug. 25, 1999.

TECHNICAL FIELD

The present invention relates to an electronic timepiece with a device for automatically adjusting month-end calendar dates and having a date display means such as a date dial.

BACKGROUND ART

Current electronic timepieces having a date display means such as a date dial require, to realize a perpetual calendar, that displayed date be read at the end of each month to compare that date with the perpetual calendar stored in the electronic circuitry.

A date reading mechanism based on an optical means is known, as disclosed, for example, in Japanese Patent Laid-Open Publication No. Hei 3-160392. According to the disclosed means, reflectors are provided on the reverse of several dates on the date dial and each reflector is detected over four consecutive dates by advancing the date dial to read the last date.

However, because reflector detection is made while the date dial is stopped, the date dial must be advanced to read the last date, thereby requiring a complicated circuit. In addition, the disclosed means require a significant amount of time to read the last date.

It is therefore an object of the present invention to provide an electronic timepiece having a device for automatically adjusting month-end calendar dates that allows quick and secure date recognition with a simple circuit.

DISCLOSURE OF THE INVENTION

In order to achieve the above-mentioned object, there is provided an electronic timepiece having a device for automatically adjusting month-end dates of calendar, comprising a date dial formed on a rear surface thereof with a detection pattern composed of a reflective part and a non-reflective part both corresponding to a date display formed on a front surface of the date dial; a 24-hour switch for generating a date dial drive signal every 24 hours; a photo sensor mechanism, having a light emitting part and a photo detecting part, for reading a boundary between the reflective part and the non-reflective part of the detection pattern at a time when the date dial moves; a control circuit for determining a date formed on the date dial through a perpetual calendar circuit and outputting a necessary additional date dial drive signal by receiving the date dial drive signal from the 24-hour switch, outputting the date dial drive signal, and then receiving a signal from the photo sensor mechanism; and a date dial driving mechanism for driving the date dial according to the date dial drive signal. In this timepiece, a change in the detection pattern corresponding to that date is discriminated as a digital signal, to enable the discrimination by the date concerned alone, resulting in a simplified discriminating mechanism and circuitry and shortened discrimination time.

The boundary between the reflective part and the non-reflective part of the detection pattern may be arranged radially relative to the rotational center of the date dial, easily excluding an error in the accuracy of the detection pattern.

The detection pattern may be a particular pattern corresponding to each of at least particular dates 28, 29, and 30. This facilitates the decision of the month end at a particular date in the forward rotation of the date dial and the decision for the feeding of the date dial.

The detection pattern may be formed also for ordinary dates other than the particular dates. This allows confirmation of the feeding of the date dial on the ordinary dates.

The photo sensor mechanism may be driven intermittently, contributing to power saving.

The photo sensor mechanism may perform a detecting operation by skipping a portion on the detection pattern that shows no change, contributing to power saving.

The non-reflective part of the detection pattern may be formed by printing. Therefore, the ordinary rear surface of the date dial forms a light reflecting surface by chemically treating the surface. This can simply form the detection pattern.

A Geneva mechanism may be used to stabilize the feeding of the date dial, the Geneva mechanism being arranged such that the boundary of the detection pattern comes over the photo receiving part of the photo sensor mechanism within a rotational range in which a flange part of the Geneva mechanism is unmeshed from an intermediate date gear of a date dial driving wheel and within a range in which a backlash of the intermediate date gear is relatively small. This prevents a detection error from occurring due to the backlash of the date dial caused by an impact or the like.

A light beam detecting circuit provided on the photo sensor mechanism may switch between detection resistors on the photo receiving part of the light beam detecting circuit according to a power supply voltage. This allows the secure detection after the signal level lowers. Because the detection resistor on the photo detecting side is small in size, the freedom of circuit arrangement increases.

A light-blocking member may be provided at portions except around a light path that travels from the light emitting part of the photo sensor mechanism to the photo detecting part through the rear surface of the date dial. This prevents the diffraction (going-around of a part) of the light, decreasing the noise.

The non-reflective part of the detection pattern may have diffused reflection. Consequently, the reflection amount on the non-reflective part is stabilized, in turn stabilizing the detection of the detection pattern.

In order to further achieve the above-mentioned object, there is provided an electronic timepiece having a device for automatically adjusting month-end dates of calendar comprising a power supply, a time holding device, and a date holding device, the time holding device having a quartz oscillator for generating a reference time, a dividing circuit for dividing the output of the quartz oscillator, and a time display means operating on the basis of the output of the dividing circuit, the date holding device having a date signal generator operating on the basis of an output made every day from the dividing circuit, a date dial controller operating on the basis of an output from the date signal generator circuit, a motor operating on the basis of an output from the date dial control circuit through a driving circuit, a gear train operated by the motor, a date display means operated by the gear train, a recognition circuit for recognizing a display content from the date display means, a latch circuit for holding an output from the recognition circuit, a decision circuit 1 for operating a transmission circuit to read out contents of a memory circuit if a content held in the latch circuit is in a particular state, a year counter and a month counter in which the content of the memory circuit is held through the transmission circuit, a decision circuit 2 for determining whether the particular state held in the latch circuit is the end date of a month relative to the year counter and the month counter and, if the particular state is found the end date, moving the date to day 1, which is the first day of each month, and updating the memory circuit, and a circuit for excluding no-existing dates for controlling the decision circuit 1, the decision circuit 2, and the date dial control circuit, wherein the data is read from the memory circuit only when a particular date from the date display means is detected. This novel constitution requires no date counters corresponding to the display dates and simplifies the initializing operation for a perpetual calendar operation simply by setting up the correct year and month data in the memory circuit performing the positional detection of the date display means.

Consequently, the discriminating mechanism and circuitry are simplified to achieve quick and secure date reading.

A time difference correcting device may be provided including a correcting means for entering the output signal into the date signal generator circuit in parallel with the output from the dividing circuit. This facilitates time difference correction.

A switch may be provided for determining whether the time difference correcting device is ready for operation, the data of the year counter and the month counter being transmitted to the memory circuit only when the switch is on, controlling a timing thereof through a timer. This smoothes the update operation.

The update operation may be performed only when a change is found in a calendar data state as compared with a previous state. This secures the timing with which the rewrite operation is performed.

A correcting means may be provided for rewriting the year and month data stored in the memory circuit, resulting in secure and easy correction.

A position counter may be provided which operates in synchronization with the display content of the date display means, the position counter being reset when the date display means displays a certain position, counting the number of shift dates from the point of the resetting to exclude month-end non-existing dates. This more reliably achieves automatic adjustment of dates at the end of months.

BEST MODE FOR CARRYING OUT THE INVENTION

The following describes the mode for carrying out the invention with reference to drawings.

First, a first embodiment of the invention will be described with reference to FIGS. 1 through 8.

Figure 1:
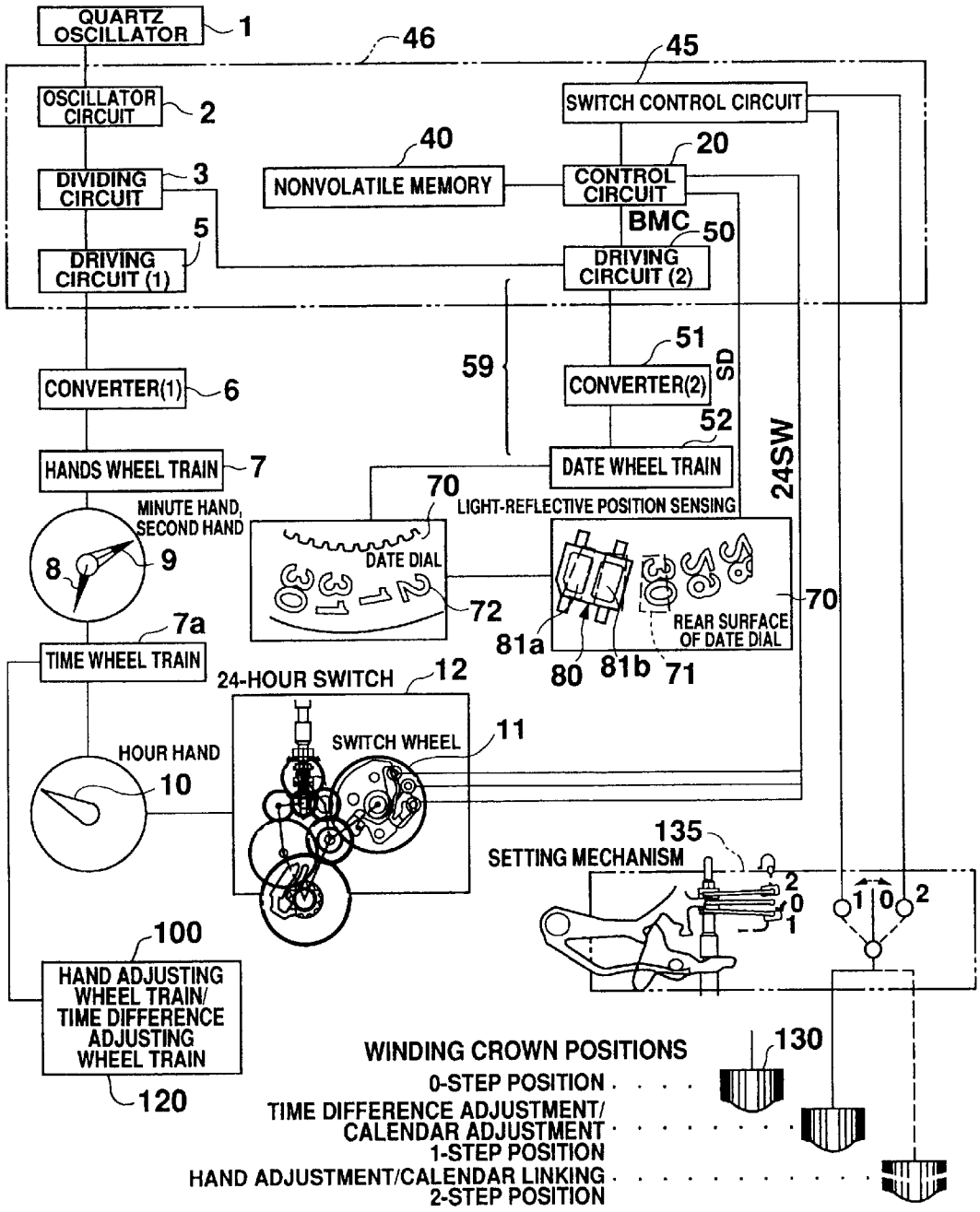
FIG. 1 is a schematic diagram illustrating an electronic timepiece according to a first embodiment of the invention.
Figure 2:
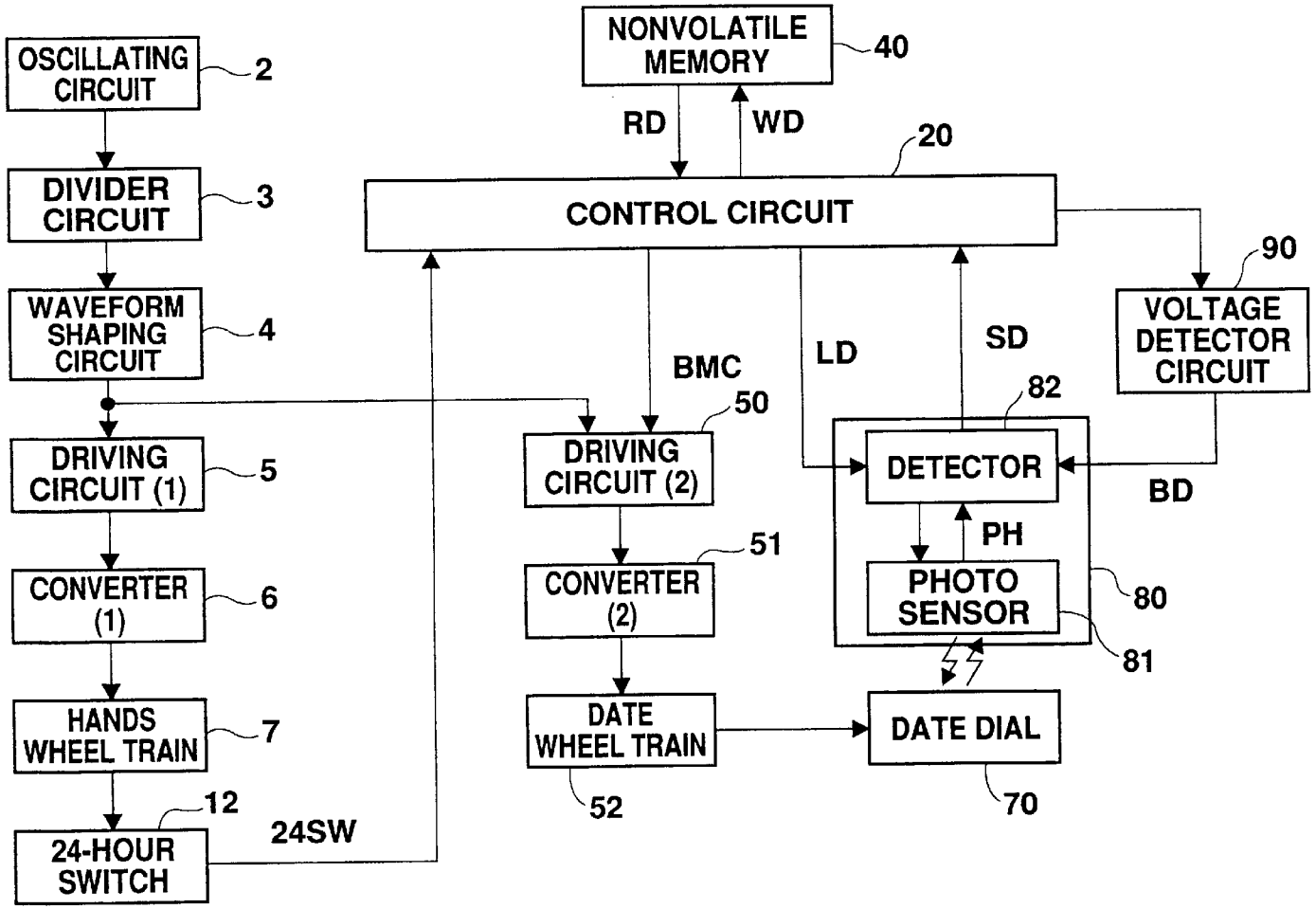
FIG. 2 is a block diagram illustrating a circuit configuration of the electronic timepiece shown in FIG. 1.

FIG. 1 is a schematic diagram illustrating an electronic timepiece having a device for automatically adjusting month-end calendar dates practiced as a first embodiment of the invention. FIG. 2 is a block diagram illustrating a circuit configuration of the electronic timepiece shown in FIG. 1.

In FIGS. 1 and 2, a signal generated by an oscillator circuit 2 for oscillating a quartz oscillator 1 is divided by a divider 3 into 1 Hz, which is shaped in waveform by a waveform shaping circuit 4 (not shown in FIG. 1), the resultant signal being supplied to a driver circuit (1) 5 for driving a converter (1) 6 for a step motor, for example. The signal of the driver circuit (1) 5 drives the converter (1) 6 every second. The rotational force of the converter (1) 6 is transmitted to a hands wheel train to rotate a second hand 8 and a minute hand 9. A time wheel train 7*a* which is part of the hands wheel train rotates an hour hand 10, and thereby rotates a switch wheel 11 that makes one turn every 24 hours to switch on a 24-hour switch 12 once every 24 hours.

A signal 24SW (date dial drive signal) for driving a date dial supplied from the 24-hour switch 12 is input to a controller 20, described later in this specification. In function, the controller 20 receives the signal 24SW to output various drive signals and to determine year, month, and day. The controller 20 exchanges data with a nonvolatile memory 40 that constitutes month and year counters. A data signal RD indicates the contents read out from the month and year counters in the nonvolatile memory 40. Data signal WD is used to update the month and year counters. The controller 20 also receives a signal for calendar correction or hand adjustment from a switch control circuit 45, for example, according to a winding crown setting position.

Receiving the signal 24SW, the controller 20 supplies a signal (a date dial drive (command) signal) BMC for driving the date dial to a driver circuit (2) 50. The driver circuit (2) 50 receives a signal from a waveform shaping circuit 4 of the timepiece main part to drive a converter (2) 51 such as a step motor. The converter (2) 51 in turn drives a date wheel train 52. The date wheel train 52 in turn drives a date dial 70. The driver circuit (2) 50, the converter (2) 51, and the date wheel train 52 make up a date dial driving mechanism 59.

The controller 20 outputs the date dial drive signal BMC and a drive signal LD for driving a photo sensor mechanism 80.

The photo sensor mechanism 80 is made up of a photo sensor 81 and its detector 82. As will be described, the date dial 70 is printed, etched, or sand-blasted on its rear surface with a detection pattern 71 composed of a reflector and a non-reflector corresponding to the date display on the front surface. The photo sensor mechanism reads the boundary in the detection pattern 71 on the rear surface of the date dial 70 according to the operation thereof, outputting a resultant detection signal SD to the controller 20.

A voltage detector 90 outputs a voltage detection signal BD to the detector 82 of the photo sensor mechanism. Referring to FIG. 1, a hand adjusting train 100 and a time difference adjusting train 120 are connected to the time wheel train 7*a*. Referring to FIG. 1, a winding crown 130 is schematically shown as set at 0-step position, 1-step position, and 2-step position by a setting mechanism, supplying signals indicative of these positions to the switch control circuit 45. It should be noted that a broken line 46 indicates that the circuits enclosed by it are accommodated on a circuit board.

Figure 3:
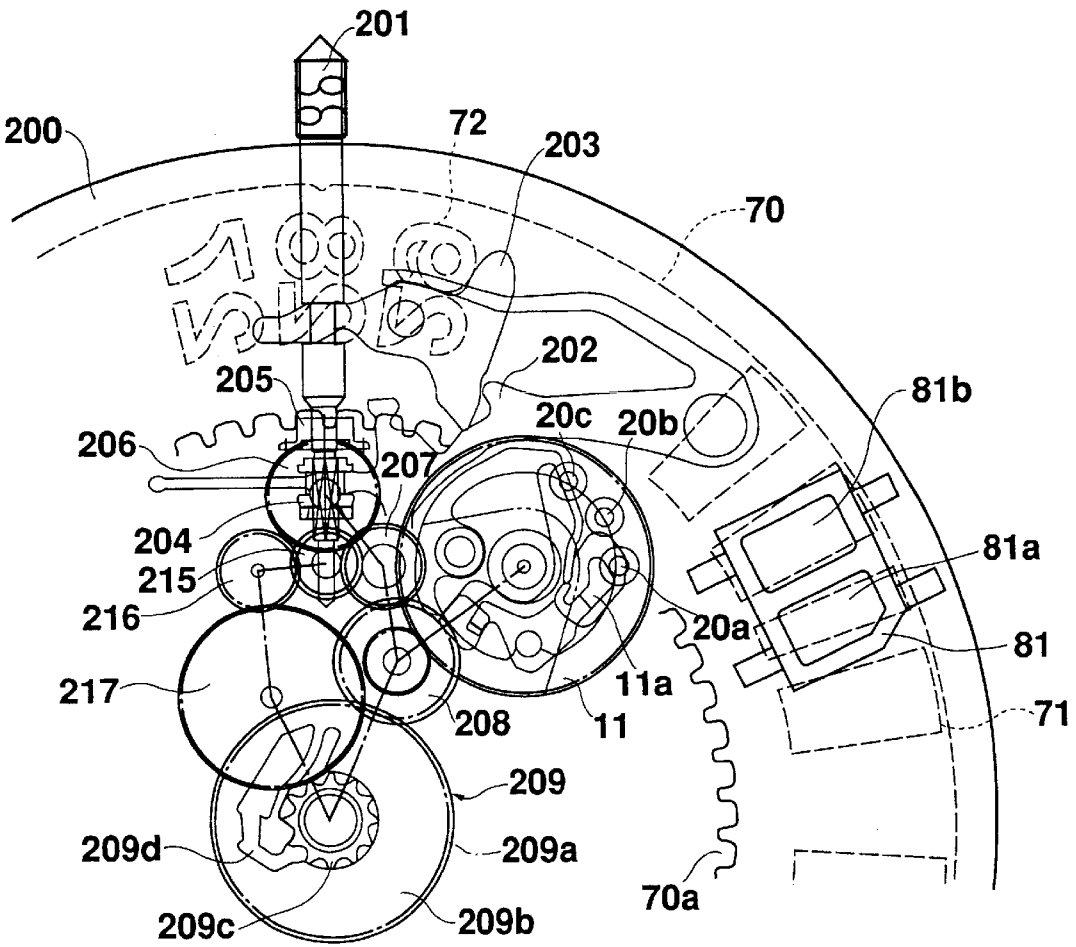
FIG. 3 is a partial arrangement diagram illustrating a hand adjusting wheel train and a time difference adjusting wheel train as viewed from the top of the timepiece shown in FIGS. 1 and 2.

The following describes the engagement and arrangement relationship between the time wheel train 7*a*, the hand adjusting wheel train 100, the time difference adjusting wheel train, the switch wheel 11, the date dial 70, and the photo sensor 81 according to the invention. FIG. 3 is a partial arrangement diagram illustrating the movement as viewed from the top (rear cover side) of the timepiece.

A base plate 200 carries an external operation switching mechanism (the setting mechanism) 135 including a winding stem 201, a setting lever 202, and a yoke 203. The external operation switching mechanism 135 defines the position of the winding stem 201 and the winding crown 130 fixed thereto. Referring to FIG. 3, the winding crown position is the 0-step position, a timepiece normally operating position.

The winding stem 201 is meshed with a clutch wheel 204 and an intermediate time corrector wheel (1) 205. When the winding stem 201 (the winding crown 130) is at the 0-step position, the rotation of the winding stem 201 (the winding crown 130) is not transmitted to any wheel.

The 1-step position in which the winding stem 201 is drawn out one step is the position in which time difference adjustment and calendar adjustment are made. When the winding stem 201 is at this position, the rotation of the winding stem 201 is transmitted to the intermediate time corrector wheel (1) 205 through the clutch wheel 204, to an intermediate time corrector wheel (2) 206 meshed with the intermediate time corrector wheel (1) 205, to an intermediate time corrector wheel (3) 207 meshed with the intermediate time corrector wheel (2) 206, and to a switch intermediate wheel 208 meshed with the intermediate time corrector wheel (3) 207.

The switch intermediate wheel 208 is meshed at its gear part with an upper hour wheel 209*a* of an hour wheel 209 having the upper hour wheel 209*a* and a lower hour wheel 209*b* slip-coupled therewith, and at its pinion part with the switch wheel 11 that constitutes the 24-hour switch 12. Therefore, at the 1-step position of the winding stem 201 (the winding crown 130), the rotation of the winding stem 201 (the winding crown 130) rotates the hour hand 10 and the 24-hour switch 12. It should be noted that the upper hour wheel 209*a* and the lower hour wheel 209*b* of the hour wheel 209 are slippingly coupled together through an hour wheel pinion 209*c* fixed to the upper hour wheel 209*a* and a jumper spring for hour wheel pinion 209*d* fixed to the lower hour wheel 209*b*.

Consequently, the rotation of the hour wheel at the 1-step position is not transmitted to a minute wheel and pinion 217 to be described.

A switch spring 11*a* is held on the switch wheel 11 to be rotated along with the switch wheel 11, coming in contact with switch terminals 20*a*, 20*b*, and 20*c* connected to a controller, and outputting a 24-hour switch signal 24SW.

The 2-step position in which the winding stem 201 (the winding crown 130) is drawn two steps is the position for hand adjustment. When the winding stem 201 is at the 2-step position, the clutch wheel 204 meshed with the winding stem 201 at its corner part meshes with a setting wheel 215, the rotation of the winding stem 201 being transmitted to an intermediate minute wheel and pinion 216, to the minute wheel and pinion 217, and to the lower hour wheel 209*b* meshed with the pinion part of the minute wheel and pinion 217. In this case, the rotation is transmitted to the switch intermediate wheel 208 meshed with the upper hour wheel 209*a* and to the switch wheel 11 without slip because the slip-coupling force between the lower hour wheel 209*b* and the upper hour wheel 209*a* is set greater than a force for rotating the switch intermediate wheel 208. Thus, at the 2-step position of the winding stem 201, the switch wheel 11 also moves in response, thereby operating the 24-hour switch 12 for calendar feed.

The date dial 70 is indicated with a dashed line in its outer circumference in FIG. 3. A date gear 70*a* forming the inner circumference is shown with a solid line. The rear surface of the date dial 70 is printed with the detection pattern 71 in response to the date display 72 on the front surface of each date dial. The photo sensor 81 is mounted on the circuit base plate (not shown) facing the detection pattern 71 printed on the rear surface of the date dial 70. The photo sensor 81 is comprises a light-emitting part 81*a* made up of a light-emitting element and a photo detecting part 81*b* made up of a photo detecting element, the light-emitting part 81*a* and the photo detecting part 81*b* being juxtaposed along the circumference of the date dial. The photo sensor 81 detects light reflected from the detection pattern 71 on the date dial.

Figure 4:
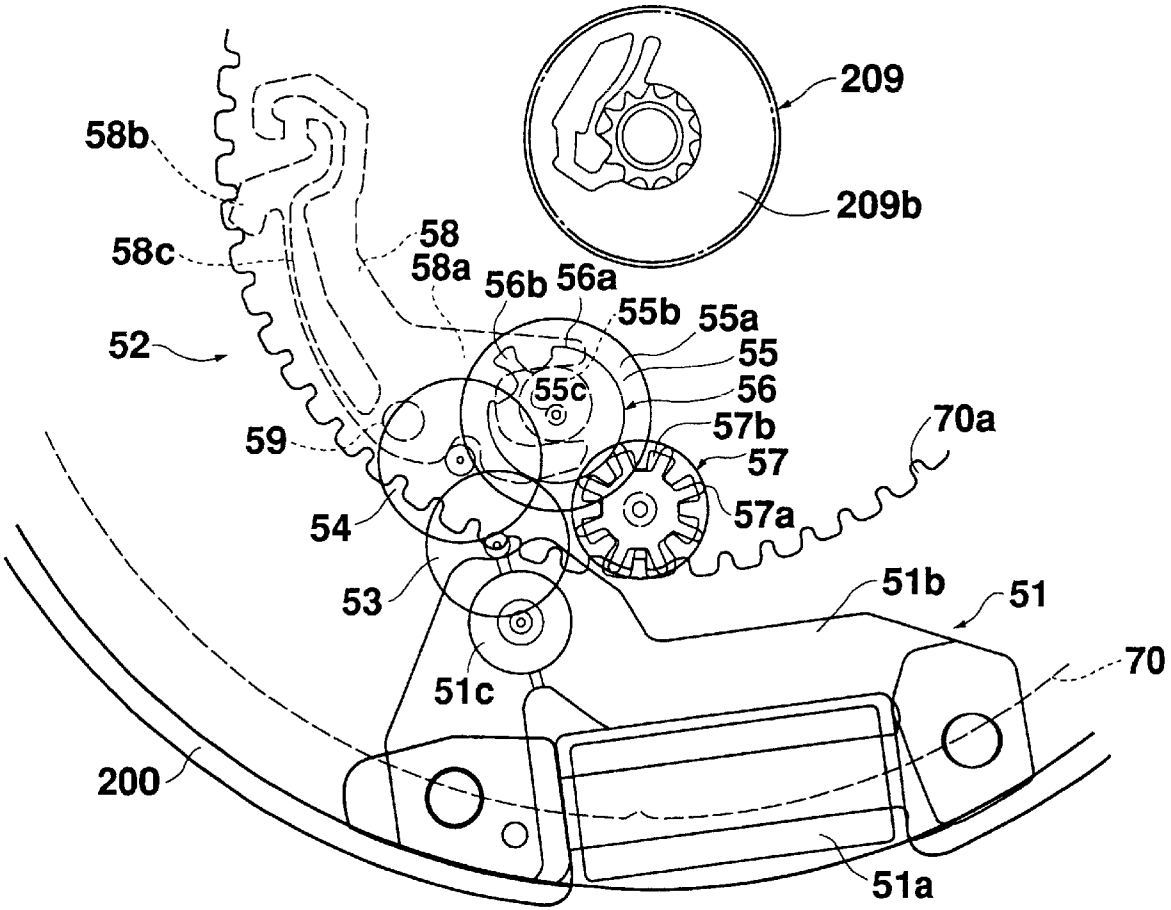
FIG. 4 is a partial arrangement diagram illustrating a converter (2) and the date wheel train as viewed from the same point of view as in FIG. 3.

FIG. 4 is a partial arrangement diagram illustrating the movement as viewed from the top (rear cover side) of the timepiece. FIG. 4 is related to FIG. 3 in that both match in vertical and horizontal directions. These drawings can be merged into one drawing by overlapping the hour wheels 209 located at the center of the movement. The converter (2) 51 and the date wheel train 52 are disposed approximately opposed to the hand adjusting wheel train 100 and the time difference adjusting wheel train 120 with the hour wheel 209 at the center of the movement being at the center of this opposed arrangement.

Figure 5:
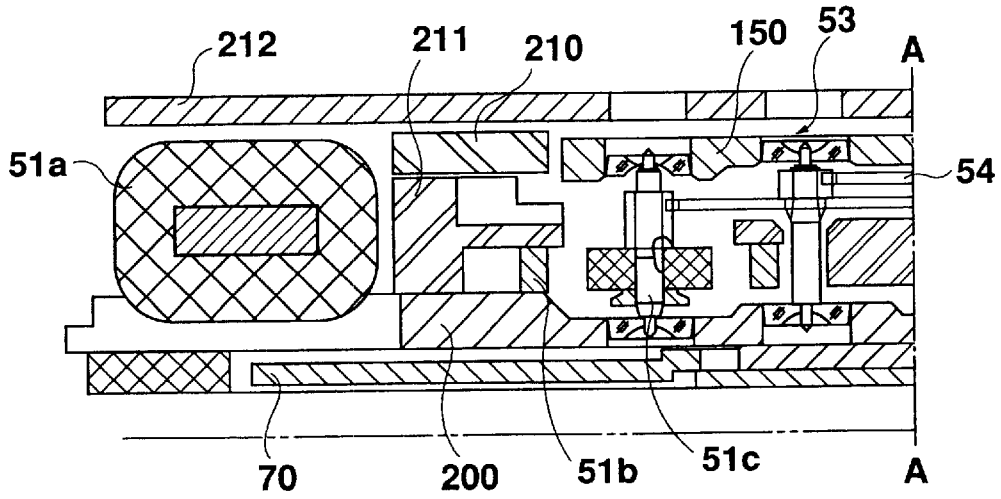
FIG. 5 is a sectional view illustrating the parts shown in FIG. 4, wherein (a) and (b) are cross sections obtained by dividing the electronic timepiece shown in FIG. 4 along line A—A.
Figure 5:
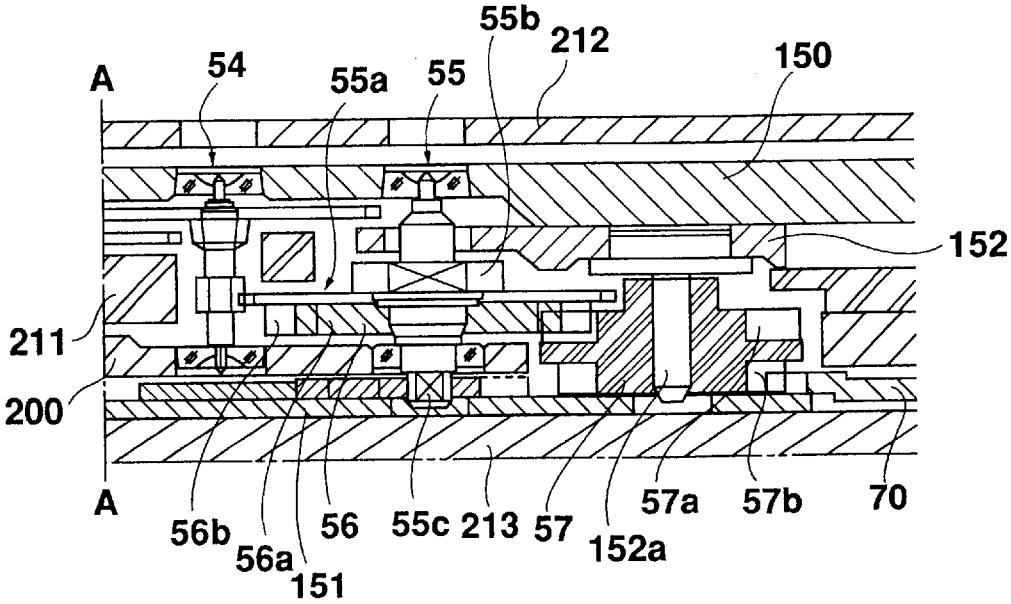

FIG. 5 is a cross section along the converter (2) 51, the date wheel train 52, and the date dial 70, division being made into (a) and (b) of FIG. 5 by dot-dash line A—A for convenience. The following description will be made with reference to FIGS. 4 and 5.

The date wheel train 52 is basically supported by the base plate 200 and a train wheel bridge 150. A date coil 51*a* and a date stator 51*b* of the converter (2) 51 are fixed to the base plate with a screw (not shown). A date dial driving wheel 57 is held by a pin 152*a* implanted in a center wheel cock 152 and clamped with a date dial clamp 151. It should be noted that reference numeral 210 denotes a circuit board, reference numeral 212 denotes a circuit holding plate, and reference numeral 56 denotes a dial plate.

When the 24-hour switch 12 is turned on, the controller 20 issues a drive (command) signal BMC for driving the converter (2) 51 to drive the converter (2) 51 through the driver circuit (2) 50. The converter (2) 50 used in the present embodiment is a step motor made up of the date coil 51*a*, the date stator 51*b*, and a date rotor 51*c*. The rotation of the date rotor 51*c* is transmitted to a date intermediate wheel (1) 53, to a date intermediate wheel (2) 54, and to a date intermediate wheel (3) 55 while being reduced in rotational speed. The date intermediate wheel (3) 55 is made up of a wheel 55*a*, a flange 56*a*, and a Geneva wheel 56 composed of a flange 56*a* and a feed tooth 56*b*, which are integrally fixed to a wheel shaft 55*c*.

The Geneva wheel 56 makes one turn per day, the feed tooth 56*b* driving an intermediate date gear 57*a* of the date dial driving wheel 57, a date dial driving gear 57*b* integral with the intermediate date gear 57*a* feeding the feed tooth 70*a* of the date dial 70 once per day. Normally, the flange 56*a* of the Geneva wheel 56 is in contact with the intermediate date gear 57*a* and prevents the date dial driving wheel 57 from being rotated.

A jumper 58 is supported by the base plate 200 around a jumper pin 59 as its center of rotation. An eccentric cam 55*b* engages with a jumper operating part 58*a* of the jumper 58 to change the flexion of a jumper spring 58*c* of a jumper part 58*b* meshing with the date wheel 70*a* and, at the same time, separates the jumper part 58*b* from the date wheel 70*a*. When the feed tooth 56*b* feeds the date dial driving wheel 57, this flexion is made smaller and the jumper part 58 is separated, thereby lowering the energy of feeding the date dial 70.

As described above, whenever the 24-hour switch 12 is turned on, the converter (2) 51 operates, feeding the date dial 70 normally for one day through the date wheel train 52. At the end of each month having 30 days, the end of February, and the end of February of a leap year, the date dial is fed additional days by the configuration of the control circuit 20 to be described.

The following describes the detection pattern 71 formed on the rear surface of the date dial 70 by a process such as printing, etching, or sand-blasting. The relationship between the detection pattern 71 and the photo sensor 81 was outlined earlier with reference to FIGS. 1 through 3.

Figure 6:
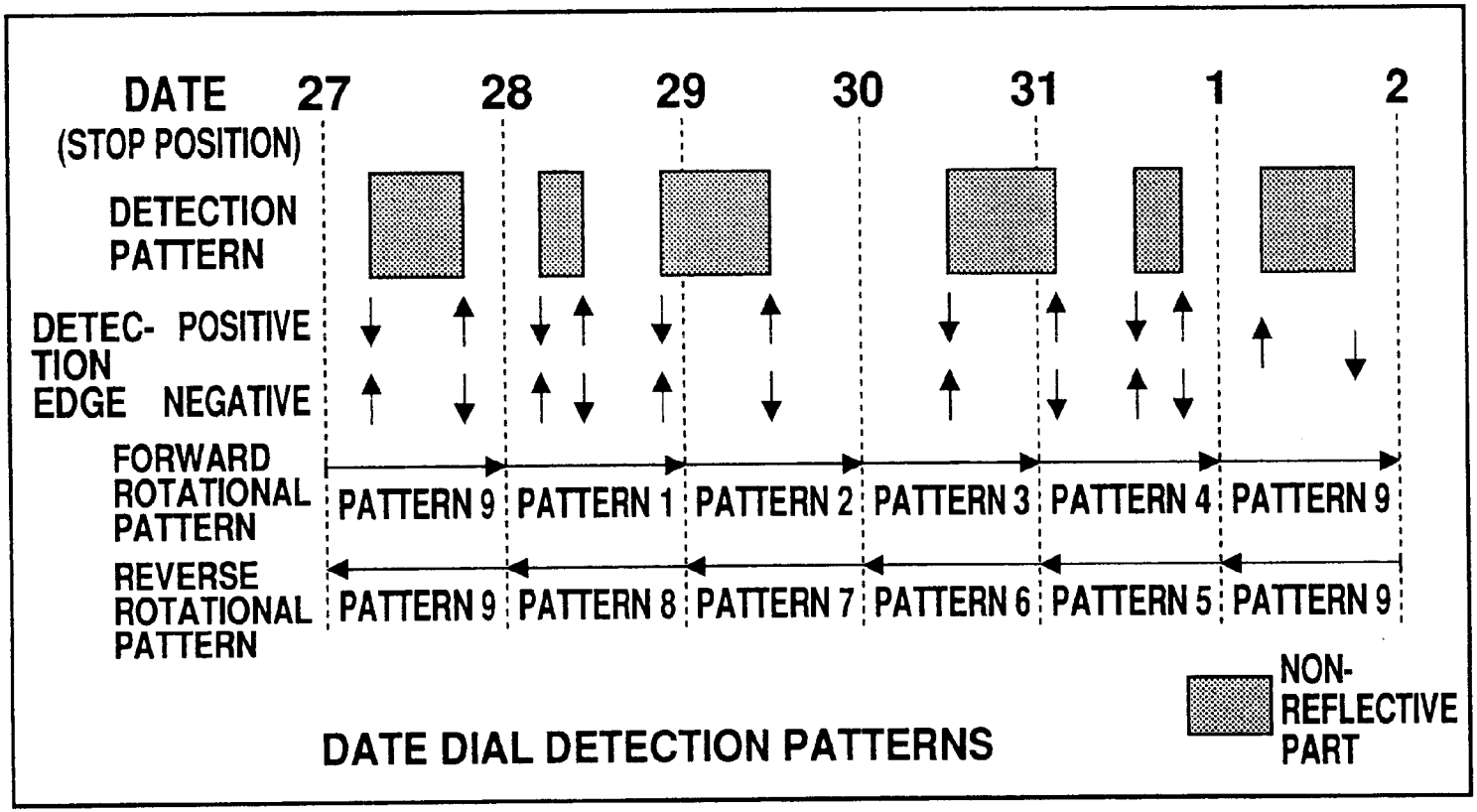
FIG. 6 is a diagram describing a detection pattern signal for use in the electronic timepiece practiced as the first embodiment.

FIG. 6 illustrates the detection patterns on the date dial.

The column at the left end indicates display items. On top of this column is "Date." Below "Date" comes "Detection Pattern" indicative of detection pattern shapes. Below "Detection Pattern" comes "Detection Edge" indicative of the change of light, in which the detection is made by detecting the change of light at the edge of detection pattern. Below "Detection Edge" come "Forward Rotational Pattern" and "Reverse Rotational Pattern" named by adding number for convenience.

It should be noted that a dashed line going down from each date denotes a position at which the detection pattern under the photo sensor stops on that day. For example, when the date dial begins rotating at the end of date 27, the detection pattern from the dashed line going down from date 27 to the dashed line going down from date 28 traverses under the photo sensor.

Figures 7, 8:
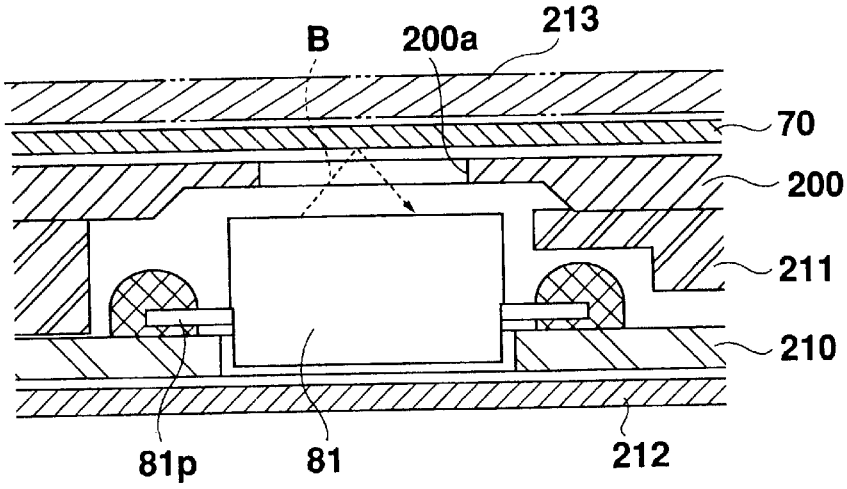
FIG. 7 is a diagram describing the detection pattern signals shown in FIG. 6.
FIG. 8 is a partial sectional view illustrating the arrangement of a photo sensor in the first embodiment of the invention.

FIG. 7 also illustrates the detection patterns. In correspondence to FIG. 6, the rotational directions of the date dial are shown in the top row followed by detection date, the positive and negative number of edge detected times, and pattern name, the correlation of these items being shown in the rows below.

The detection pattern 71 on the date dial 70 is composed of reflective parts (the white portions shown in FIG. 6) and non-reflective parts (the black portions shown in FIG. 6), the boundary between them being arranged radially relative to the rotational center of the date dial as shown in FIG. 3. In FIG. 6, however, each pattern segment is drawn rectangularly for convenience. Each non-reflective part can be formed by etching, sand-blasting, matte printing, black printing, or the like.

In FIGS. 6 and 7, the timing with which the detection edge traverses from the reflective part to the non-reflective part is indicated by a down-arrow, which is negative, and from the non-reflective part to the reflective part is indicated by an up-arrow, which is positive.

For example, when date changes from 27 to 28, the detection pattern for detecting this change is the detection pattern for the ordinary dates. In the forward rotation of the date dial, one down-arrow negative signal and one up-arrow positive signal are detected. This is labeled pattern 9. Pattern 9 holds true with the reverse rotation in the ordinary date on which change is made from date 28 to date 27. The change from date 1 to date 2 is also pattern 9 in both forward and reverse rotations.

When the date changes from 28 to 29 and the rotation is forward, the detection edge appears in negative down-arrow, positive up-arrow, and negative down-arrow, in this order. In this case, the edge detection count is 1 for positive and 2 for negative. This is called pattern 1. In the present embodiment, pattern discrimination is made in the circuit on the basis of the number of positive and negative signals. In the reverse rotation of the date dial, the same pattern appears as a pattern that changes from date 1 to date 31. This pattern is discriminated by forward rotation or reverse rotation, so that this pattern is pattern 5.

Likewise, for the particular dates 28, 29, 30, and 31, the detection pattern has shapes for discriminating these dates in both forward and reverse rotations of the date dial. However, if the correction of the date dial is made only by forward rotation, dates 28, 29, and 30 may only be discriminated while date 31 may only be discriminated like an ordinary date. For the ordinary dates, the detection pattern for regular feed can be omitted. In the present embodiment, the detection pattern for the ordinary dates is provided only to confirm that the date dial has been fed by one day.

The following describes the arrangement of the photo sensor mechanism and the detection signals associated therewith.

FIG. 8 is a cross section illustrating the arrangement of the photo sensor 81 used in the timepiece of the embodiment. Four terminals 81*p* of the photo sensor are soldered to a circuit terminal (not shown) of the circuit board 210. The photo sensor 81 is accommodated in the through-hole of a spacer 211 and arranged between a circuit support plate and the date dial 70, covered with the base plate 200 having a hole 200*a*. The date dial 70 is covered with a dial plate 213. Like the arrow B, a beam of light output from the light emitting part of the photo sensor 81 passes the hole 200*a* of the base plate 200 and reaches the rear surface of the date dial 70. Whether or not this beam is reflected from the rear surface depends on the detection pattern onto which the beam is projected. The reflected beam passes the hole 200*a* of the base plate 200 and is received by the photo detecting part of the photo sensor 81. Arrow B indicates the light beam path. If the light beam is not blocked by being covered around the hole 200*a* of the base plate 200, the light beam from the light emitting part is scattered and a scattered portion of the light beam enters the photo detecting part, deteriorating the S/N ratio of detection.

Covering the associated portions except for the light path with a member such as the base plate 200 blocks the scattered light, enhancing the S/N ratio of detection.

Figure 9:
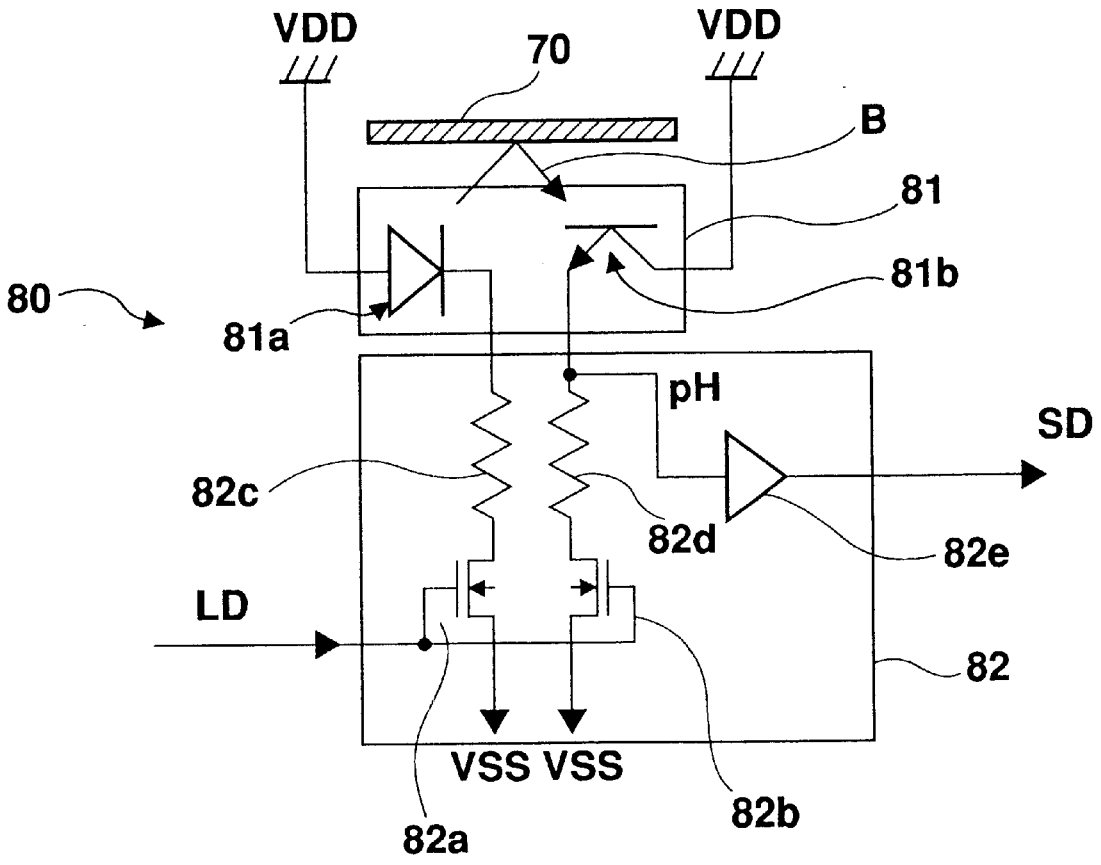
FIG. 9 is a circuit diagram illustrating a photo sensor mechanism in the first embodiment of the invention.

FIG. 9 is a circuit diagram illustrating the internal circuit of the photo sensor mechanism 80 composed of the photo sensor 81 and the detector 82. FIG. 9 shows an example in which the detector is not connected to the voltage detector 90.

When a drive signal LD for the photo sensor mechanism is output from the controller 20 by the signal 24SW supplied from the 24-hour switch 12 to drive a FETs 82*a* and 82*b* of the detector 82 of the photo sensor 81, a current flows through the light emitting part 81*a* of the photo sensor 81 from level VDD to level Vss across a resistor 82*c*, outputting a light beam B. The light beam B, if reflected from the rear surface of the date dial 70, reaches the photo detecting part 81*b* to drive the same, upon which a current flows from level VDD through a detection resistor 82*d* and the FET 82*b* to level Vss. The detection resistor 82*d* gives a H level signal PH to a comparator 82*e*, the high level signal PH is waveform-shaped by the comparator 82*e*, and the waveform-shaped signal is outputted from the detector 82 as a detection signal SD. If the light beam B is projected to a non-reflective pattern on the date dial 70 and therefore not reflected therefrom, the photo detecting part 81*b* is not driven, setting the detection signal SD to L level.

Figure 10:
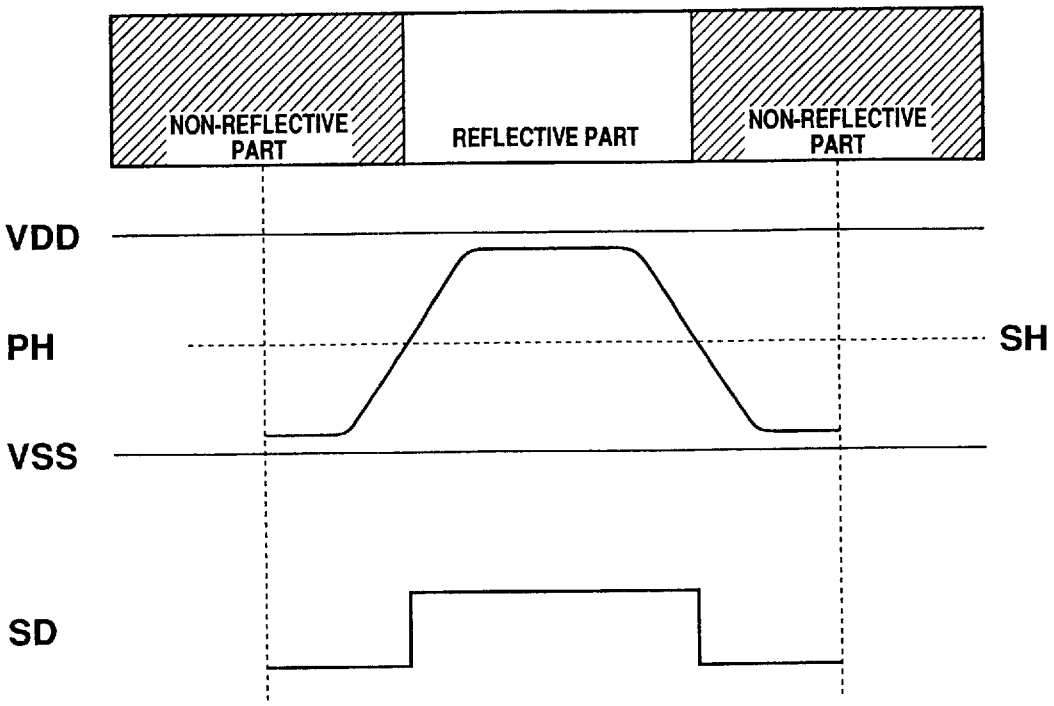
FIG. 10 is a waveform diagram illustrating the signals associated with the photo sensor mechanism shown in FIG. 9.

FIG. 10 is a waveform diagram (a timing chart) illustrating the various signals associated with the photo sensor mechanism, in which the horizontal axis represents time. A detection pattern on the date dial is shown for example at the top of the diagram. Below the detection pattern, the corresponding signals are shown. The output signal PH of the photo sensor does not exceed a threshold SH if the light beam B is projected to a non-reflective detection pattern and exceeds the threshold SH if the light beam B is projected to a reflective detection pattern. The signal SD waveform-shaped by the comparator is shown at the bottom of the diagram.

In the above-mentioned example, the photo sensor mechanism 80 is not connected to the voltage detector 90. The following describes an example in which the sensitivities of the photo sensor mechanism are selected by the voltage detector 90.

Figure 11:
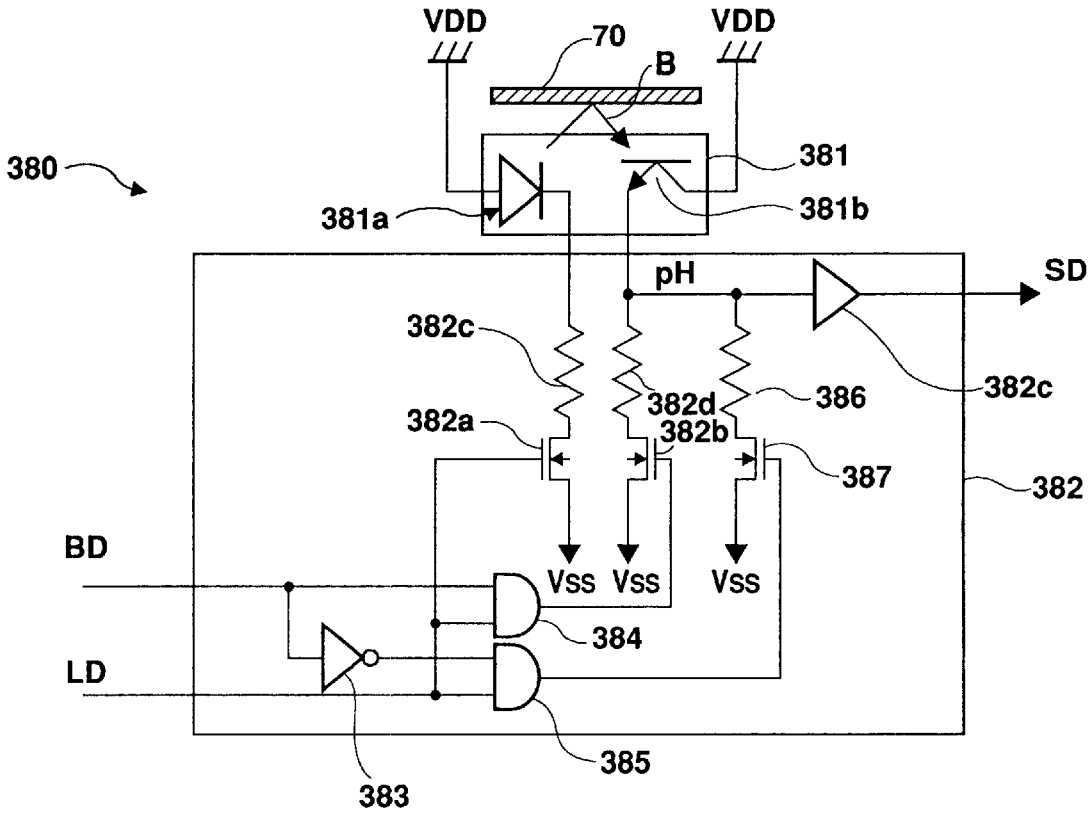
FIG. 11 is a circuit diagram illustrating a photo sensor mechanism of another form in the first embodiment of the invention.

FIG. 11 is a circuit diagram illustrating the internal circuit of a photo sensor mechanism 380 like that shown in FIG. 9. In the example of FIG. 11, a detector 382 is provided with an input terminal for a voltage detection signal BD and added with an inverter 383, an AND gates 384 and 385, a detection high resistor 386, and a FET 387. Based on the signal 24SW supplied from the 24-hour switch 12, the controller 20 outputs a drive signal LD to the photo sensor mechanism.

On the other hand, the voltage detector 90 shown in FIG. 2 operates as directed by the controller 20, the voltage detection signal being given to the detector. The voltage detection signal BD goes H level when the supply voltage is over a certain level and L level when not.

When the drive signal LD goes H level and a H level signal indicative of a normal power supply state comes from the signal BD, the output of the AND gate 384 goes H level and the output of the AND gate 385 goes L level because the signal BD is given thereto through the inverter 383. Consequently, the FET 382*a* and the FET 382*b* are turned ON and the FET 387 is turned OFF. The light beam B from the light emitting part 381*a* is reflected from the date dial 70. When a current consequently flows in the photo detecting part 381*b*, the output signal PH of the photo detecting part 381*b* becomes H level because of a detection low resistor 382*d*, the detection signal SD being output as H level through the comparator 382*c*.

Because the drive signal given as H level drops the supply voltage, if the voltage detection signal is given as L level, the output of the AND gate 384 becomes L level and the output of the AND gate 385 goes H level. Consequently, the FET 382*a* is turned ON and the FET 382*b* is turned OFF, turning ON the FET 387 instead of this FET 382*b*.

Because of the lowered supply voltage, the intensity of the light beam B from the light emitting part 381*a* becomes low compared with that on the normal supply voltage level. When a current flows in the photo detecting part 381*b*, its output signal PH is set to H level by the detection high resistor 386 and the detection signal SD is output also as H level through the comparator 382*c*.

Namely, in the embodiment shown in FIG. 11, the detection low resistor 382*d* and the detection high resistor 386 are switched between by the change in voltage, correcting the drop in the sensitivity of the photo sensor 381 through the detector. This correction by switching between the resistors on the side of the photo detecting part 381*b* allows setting of the resistor value on the photo detecting part to a large value and reduction in size of the FET 382*a* and the FET 382*b*, thereby enhancing the freedom of design.

Figure 12:
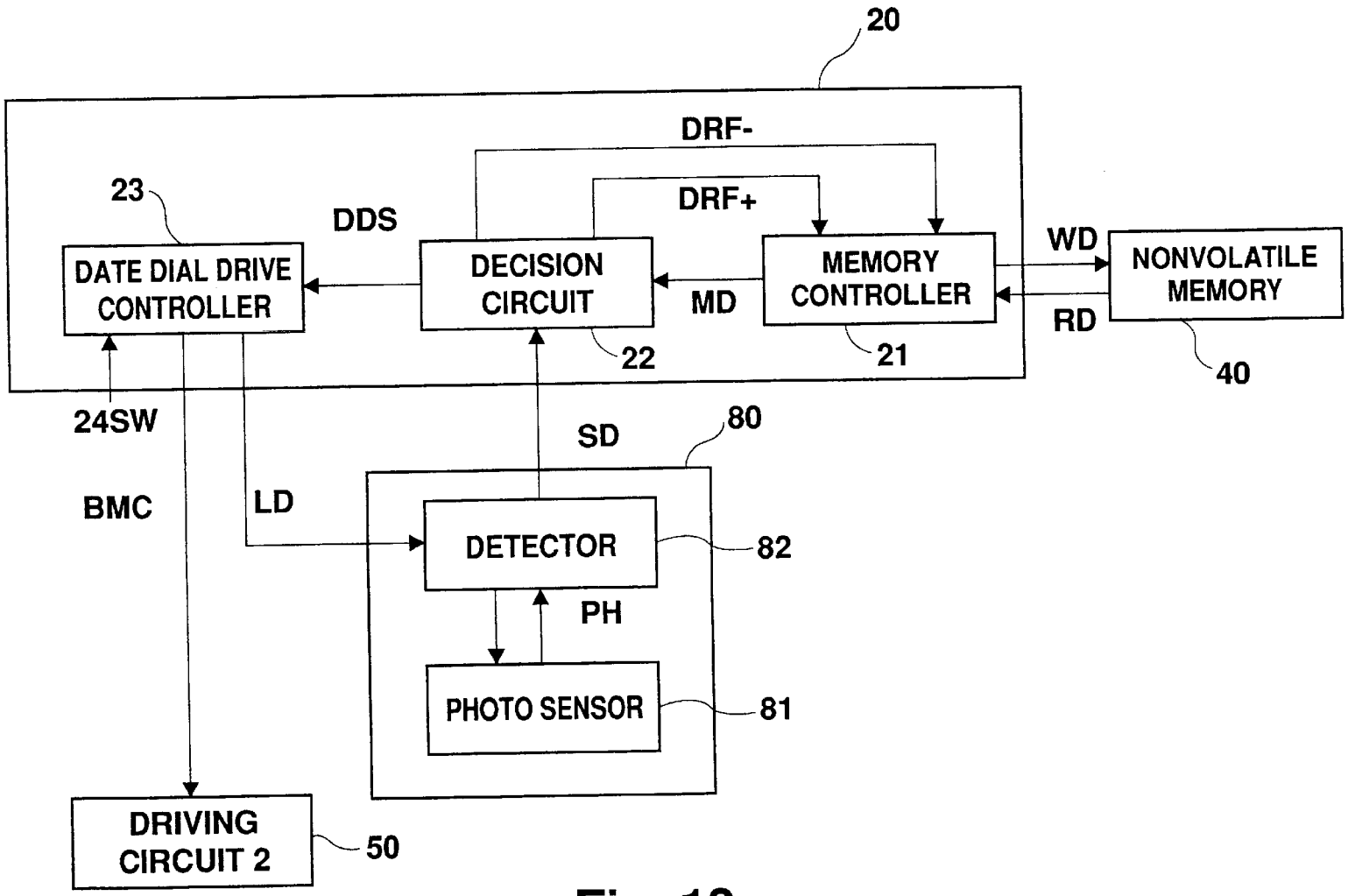
FIG. 12 is a circuit block diagram illustrating the contents of a controller 20 shown in FIG. 2.
Figure 13:
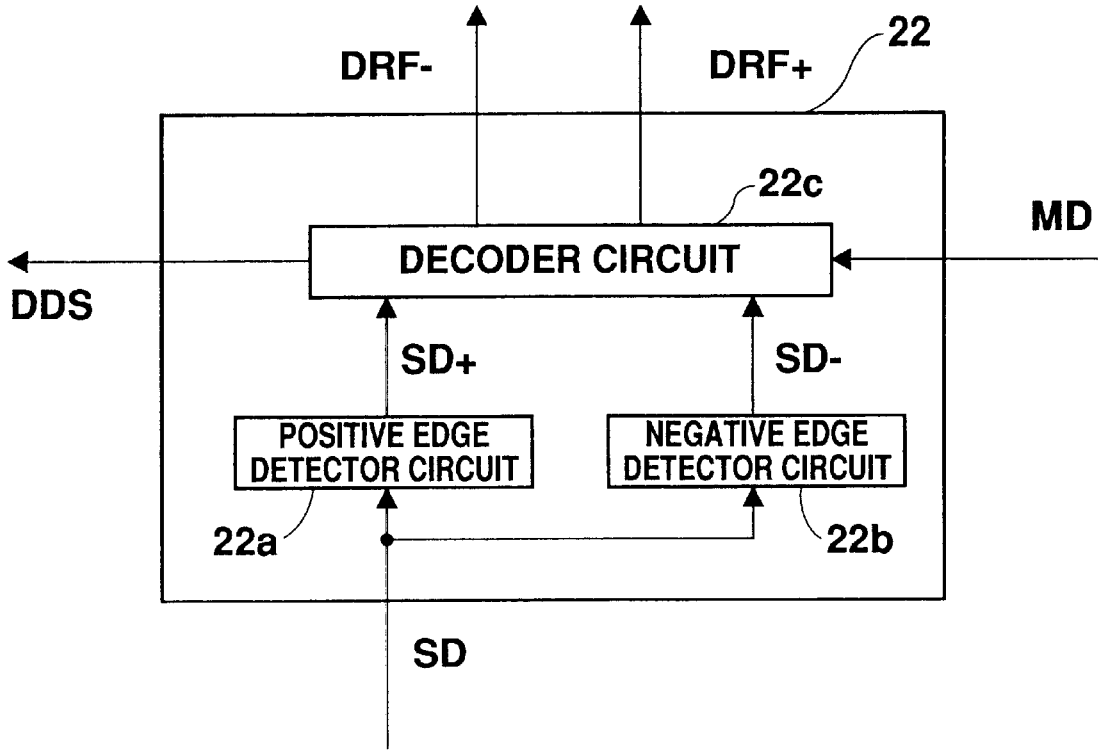
FIG. 13 is a circuit block diagram illustrating the contents of a decision circuit in the controller 20 shown in FIG. 12.

The following describes details of the controller 20 shown in FIG. 2 with reference to FIGS. 12 and 13.

FIG. 12 is a circuit block diagram illustrating details of the controller 20. FIG. 13 is a circuit block diagram illustrating a decision circuit in the controller 20.

The controller 20 is basically composed of a memory control circuit 21, a decision circuit 22, and a date dial drive control circuit 23.

Referring to FIG. 12, components similar to those previously described with FIG. 2 are denoted by the same reference numerals. Receiving the signal 24SW from the 24-hour switch 12, the controller 20 outputs the drive signal LD through the date dial drive control circuit 23. The photo sensor mechanism 80 detects the detection pattern 71 on the date dial and sends the detection signal SD to the decision circuit 22 as described earlier. The nonvolatile memory 40, which retains its contents when the power is turned off, holds the count values of the months and years that can be rewritten by a month data update signal WD supplied from the memory control circuit 21 to be described. The month and year count values stored in the nonvolatile memory 40 are read by a read signal RD into the memory control circuit 21. The memory control circuit 21 supplies a month and year information signal MD to the decision circuit 22. Upon receiving the detection signal SD containing date information, the decision circuit 22 determines the current year, month, and day on the basis of the information in the signal, and through a perpetual calender circuit incorporated (constituted) in the decision circuit, supplying a date dial drive amount command signal DDS to the date dial drive control circuit 23 to cause the same feed the date dial by the specified number of dates.

On the other hand, the decision circuit 22 a month update signal DRF+ to the memory control circuit 21. Based on this signal, the memory control circuit 21 supplies the month data update signal WD to the nonvolatile memory 40 as described above, upon which the year and month count values in the nonvolatile memory 40 are updated to the contents of the next month.

Receiving the date dial drive amount command signal DDS, the date dial drive control circuit 23, in addition to the feed for one day based on the signal 24SW received from the 24-hour switch 12, supplies the date dial drive signal (the drive signal for the converter (2) 51) BMC for adding necessary dates to the driver circuit (2) 50. Consequently, the date dial is automatically fed by the amount necessary at the end of that month.

It should be noted that a signal DRF− shown in FIG. 12 denotes a month updating signal for use in the correction in reverse rotation.

This also updates the month and year count values in the nonvolatile memory 40 through the update signal WD.

Referring to FIG. 13, components similar to those previously described with FIG. 12 are denoted by the same reference numerals.

The decision circuit 22 is principally composed of a positive edge detector 22*a*, a negative edge detector 22*b*, and a decoder circuit 22*c*. As described with reference to FIGS. 6 and 7, the detection signal SD outputted from the photo sensor mechanism 80 is supplied to the positive edge detector 22*a* to output a positive edge signal SD+ if the edge detection signal of the date dial detection pattern 71 is positive or supplied to the negative edge detector 22*b* to output a negative edge signal SD− if the edge detection signal is negative. The +SD and −SD signals are supplied to the decoder circuit 22*c*. The decoder circuit 22*c* counts these signals to determine the date. The decoder circuit 22*c* also receives the year and month information signal MD from the above-mentioned memory control circuit 21 to determine the month and year.

These determination operations are made by the perpetual calendar circuit incorporated in the decoder circuit 22*c*. The decoder circuit 22*c* determines the number of dates to be fed and outputs a resultant date dial drive amount command signal DDS. To be more specific, the decoder circuit 22*c* incorporates a logic circuit (the perpetual calendar circuit) for discriminating a perpetual calendar (year, month, and day) and a logic circuit for determining the number of dates to be fed. Normally, this DDS signal is not output because no additional date dial drive operation is required for ordinary dates. The date dial drive amount command signal DDS for one day is output on date 30 of each month with exactly 30 days. The date dial drive amount command signal DDS for three days is output on date 28 of the February of every ordinary year. The date dial drive amount command signal DDS for zero days is output on date 28 of the February of every leap year. The date dial drive amount command signal DDS for two days is output on date 29 of the February of every leap year. This causes the above-mentioned date dial drive control circuit 23 to output the date dial drive signal BMC for adding the necessary number of dates 0 through 3.

The decoder circuit 22*c* also outputs a month update signal DRF− for the correction in reverse rotation as opposed to the update signal DRF+ that is updated in the correction in forward rotation.

The following describes an example in which the photo sensor mechanism 80 is driven intermittently.

Figure 14:
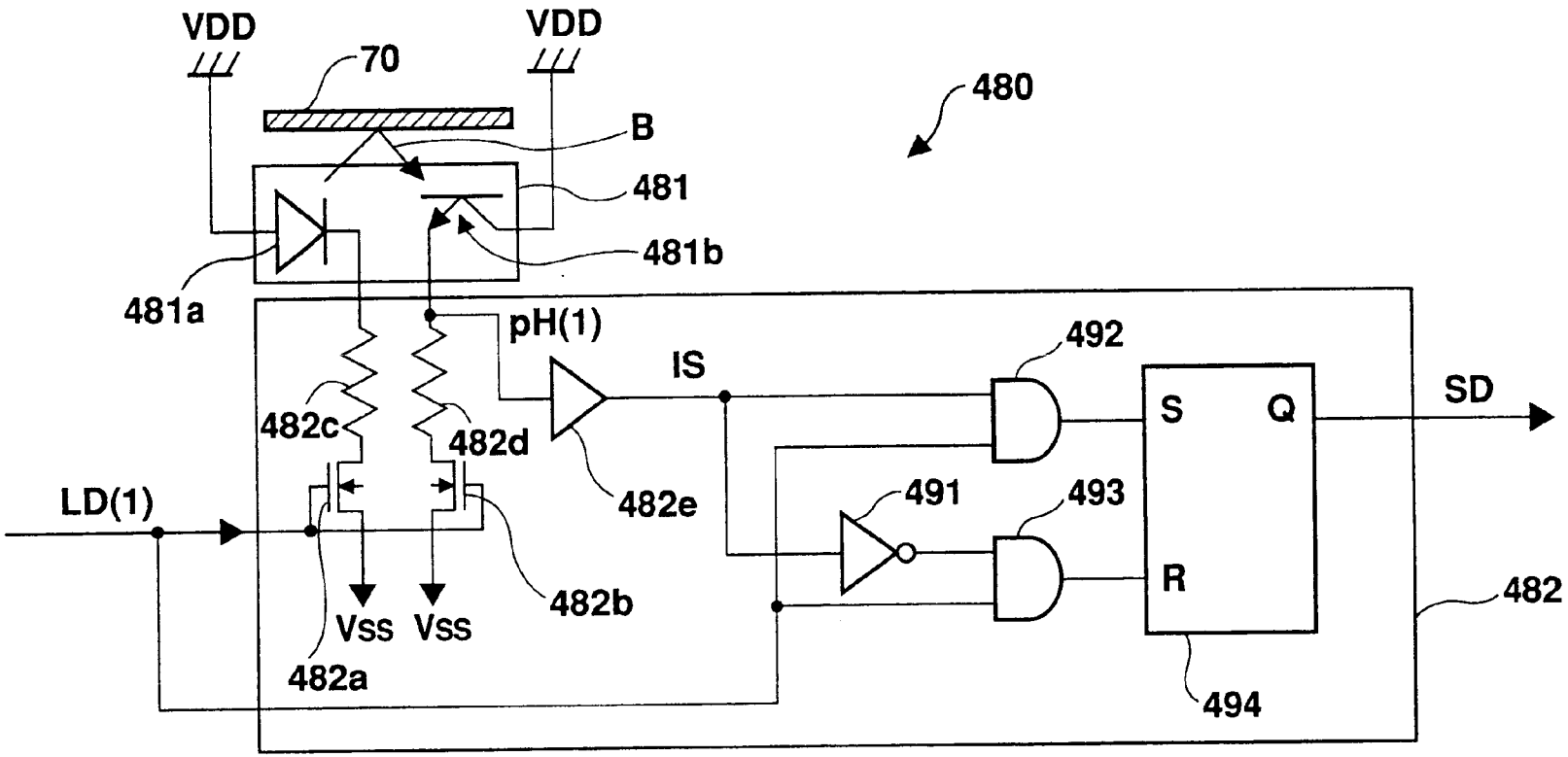
FIG. 14 is a circuit diagram illustrating another form of the circuit of the photo sensor mechanism in the first embodiment of the invention.
Figure 15:
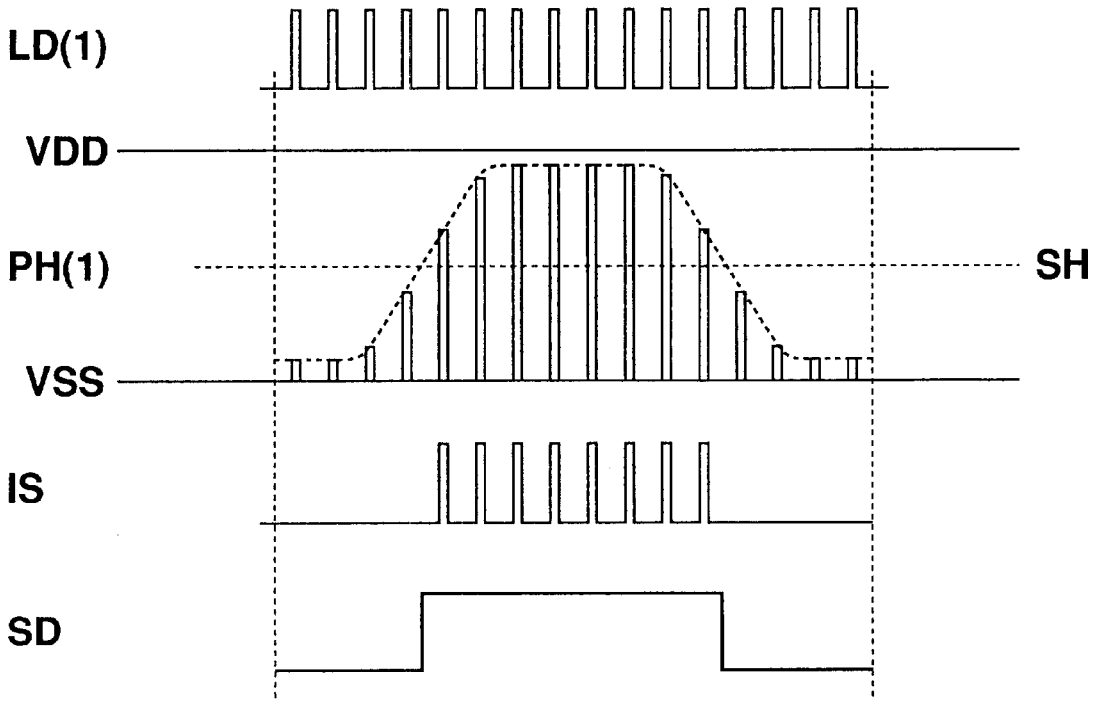
FIG. 15 is a waveform diagram illustrating the signals associated with the circuit shown in FIG. 14.

FIG. 14 is a circuit diagram illustrating a photo sensor that is driven intermittently. FIG. 15 is a waveform diagram illustrating the signals associated with the circuit shown in FIG. 14.

With reference to FIG. 14, components similar to those previously described with FIG. 9 are denoted by adding 400. The detection drive signal LD(1) of a corresponding photo sensor mechanism 480 is given as an intermittent signal indicated at the top of the waveform diagram in FIG. 15 which is obtained by shaping a signal supplied from a divider. Based on this signal, the output signal from the photo sensor 481 provides an intermittent signal having a waveform as shown in PH(1) of FIG. 15 according to the detection pattern on the date dial, the detection pattern shown in FIG. 10 for example. The intermittent detection signal that passed a comparator 482*e* is picked up if it exceeds the threshold, providing an intermittent detection signal IS shown in FIG. 15. This signal IS is made a detection signal SD by a shaping circuit composed of an inverter 491, AND gates 492 and 493, and a set/reset FF 494, the detection signal SD being supplied to the above-mentioned control circuit 20.

To be more specific, when both the signal LD(1) and the signal IS go H level, the S terminal of the set/reset FF 494 is driven to set the FF 494, thereby setting the output signal from the Q terminal to H level. When the signal IS goes L level when the signal LD(1) is H level, the R terminal is driven to reset the FF 494, thereby resetting the signal from the Q terminal to L level.

The following describes still another embodiment of the photo sensor mechanism. The drive signal for this photo sensor mechanism is an intermittent signal basically similar to that described with reference to FIGS. 14 and 15. In this example, directing attention to that the detection pattern on the date dial does not change over several intermittent pulses, the photo sensor mechanism is driven by omitting (skipping) the intermittent drive signal.

Figure 16:
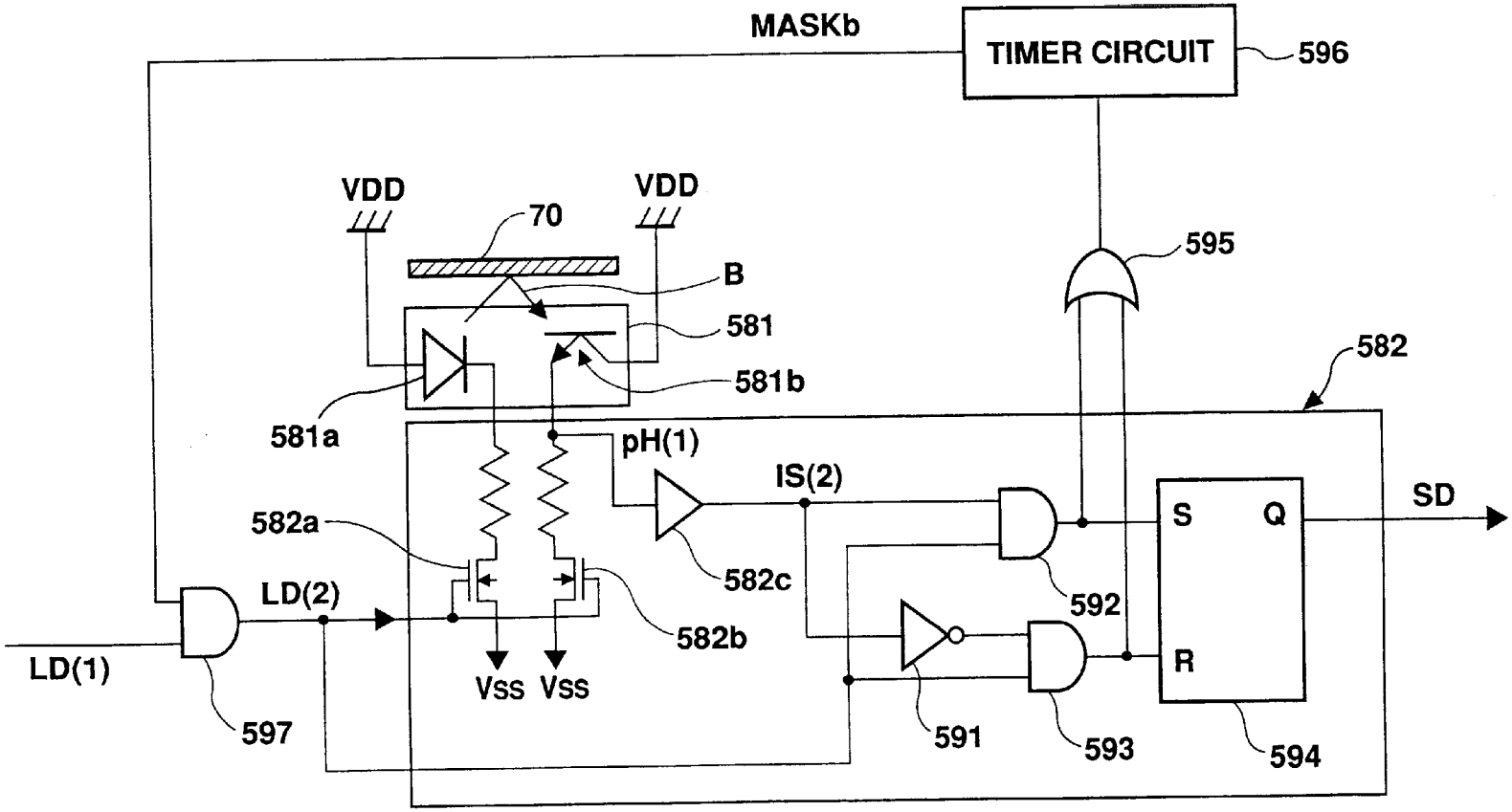
FIG. 16 is a circuit diagram illustrating still another form of the photo sensor mechanism in the first embodiment of the invention.
Figure 17:
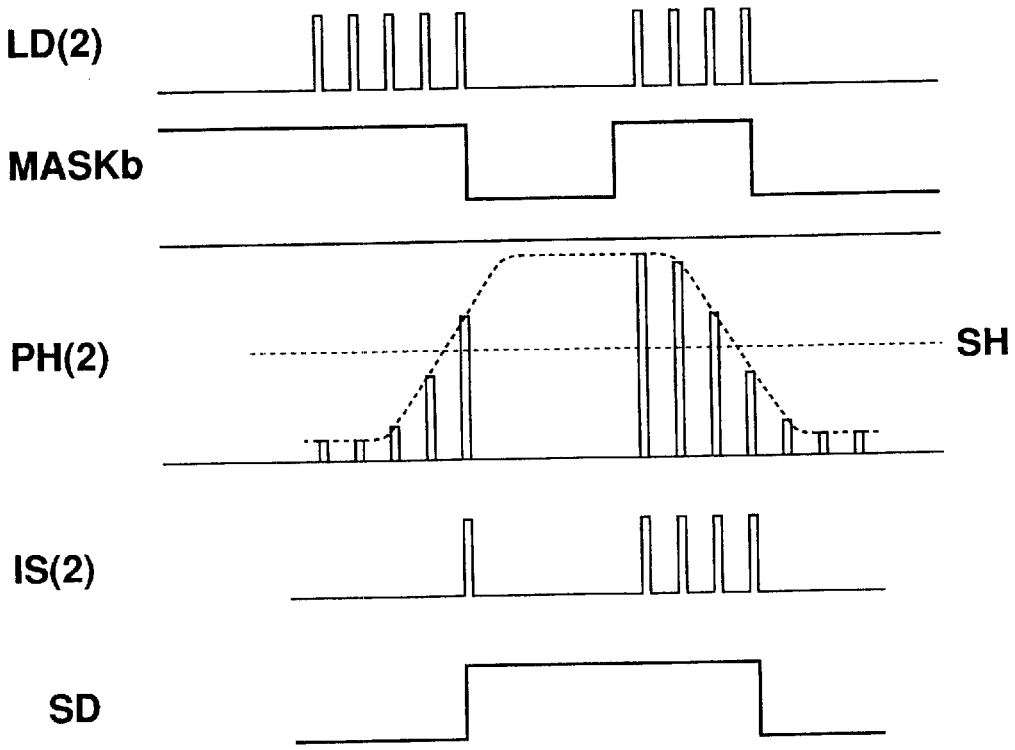
FIG. 17 is a waveform diagram illustrating the signals associated with the circuit shown in FIG. 16.

FIG. 16 is a circuit diagram illustrating the circuit of the above-mentioned photo sensor mechanism with the intermittent drive signal omitted. FIG. 17 is a waveform diagram illustrating the signals associated with this photo sensor mechanism.

Referring to FIGS. 16 and 17, components similar to those previously described with reference to FIGS. 14 and 15 are denoted by adding 100 and the corresponding signals are denoted by adding (2). Components added to the photo sensor mechanism shown in FIGS. 14 and 15 are an AND gate 592, an OR gate 595 in which a signal from the AND gate 592 is inputted, a timer circuit 596, and an AND gate 597 into which a signal from the timer circuit 596 and the intermittent drive signal LD(1) are input.

The intermittent drive signal LD(1) is the same as that shown in FIGS. 14 and 15. Because an initial mask signal MASKb from the timer circuit 596 is at H level, an LD(2) that passed the AND gate 597 goes H level when the LD(1) is at H level, upon which the timer circuit 596 is driven by a first intermittent detection signal IS(2) through the AND gate 592, outputting the mask signal MASKb shown in FIG. 16.

This mask signal MASKb causes the output signal of the AND gate LD(2) to become as shown at top of the waveform diagram of FIG. 17. A time interval until the timer circuit 596 restarts is set in correspondence to the detection pattern 71 on the date dial. In the example of FIG. 17, the time interval is set in correspondence to the non-reflective part and the reflective part shown in FIG. 10.

Consequently, an output signal PH(2) of the photo sensor becomes as shown in FIG. 17 and the intermittent detection signal IS(2) also becomes as shown in FIG. 17. The timer circuit 596 is also driven through the OR gate 595 by a reset signal to a set/reset FF 594, outputting the mask signal MASKb for masking the drive signal LD(1) for a certain period thereafter. The detection signal SD takes, through the set/reset FF 594, a waveform as shown in FIG. 17 as with the examples of FIGS. 10 and 15.

The following describes a configuration in which the erroneous detection of the detection pattern due to external impact during date dial feeding is reduced. As described with reference to FIGS. 4 and 5, the date wheel train 52 feeds the date dial 70 by sequentially transmitting the rotational force supplied from the converter (2) 51 to the date intermediate wheel (1) 53, the date intermediate wheel (2) 54, the date intermediate wheel (3) 55, the Geneva wheel 56 fixed to the date intermediate wheel (3) 55, the intermediate date gear 57*a* of the date dial driving wheel 57, the date dial driving gear 57*b* of the date dial driving wheel 57, and the date wheel 70*a* of the date dial 70. In the normal standby state, the play amount (backlash) of the date dial 70 due to impact is held small by the meshing of the flange 56*a* of the Geneva wheel 56 with the intermediate date gear 57*a* of the date dial driving wheel 57 and by jumping of the date gear 70*a* of the date dial 70 by the jumper part 58*b* of the jumper 58. However, when the flange 56*a* unmeshes from the intermediate date gear 57*a*, the backlash of the intermediate date gear 57*a* becomes extremely large in the rotational direction. This backlash of the intermediate date gear 57*a* also corresponds to the backlash of the date dial.

Figure 18:
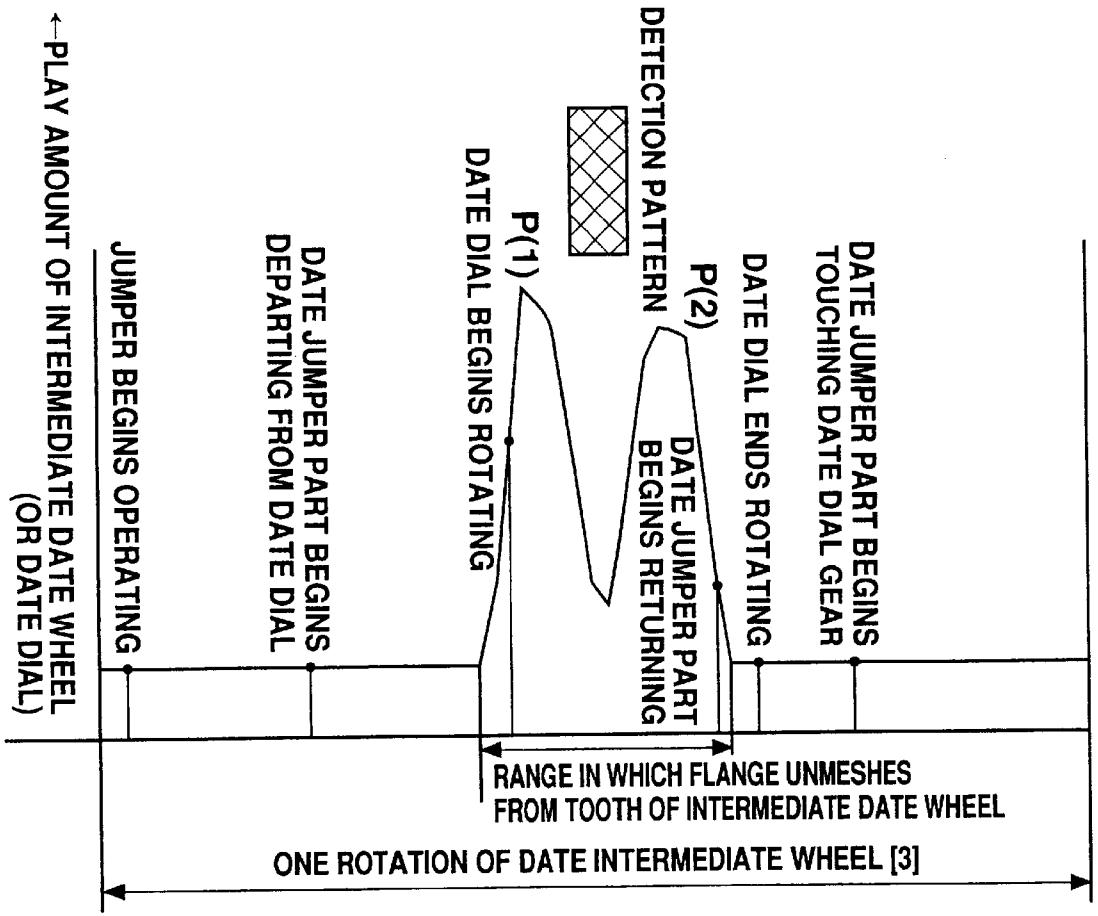
FIG. 18 is a diagram illustrating a relationship between the play amount (backlash) of an intermediate date gear in the first embodiment of the invention and a detection pattern of the wheel.

FIG. 18 illustrates the relationship between the backlash of the intermediate date wheel (or the date dial) and the detection pattern. The horizontal axis represents the rotational range (for one rotation) of the date intermediate wheel (3) and the vertical axis represents the play amount of the intermediate date wheel (or the date dial).

The illustrated play amount was measured with the date intermediate wheel (3) stopped at many rotational positions. This backlash naturally increases in the range in which the flange 56*a* unmeshes from the intermediate date gear 57*a*; within this range, however, the backlash varies as shown in FIG. 18 depending on the position of the feed tooth 56*b* of the Geneva wheel fixed to the date intermediate wheel (3). Especially, the backlash appears in two peaks P(1) and P(2). In the present embodiment, the arrangement is made such that the boundary of the detection pattern of the date dial comes over the photo detecting part of the photo sensor mechanism by circumventing the portions around these two peaks. This relationship is illustrated in FIG. 18 by schematically drawing the detection pattern. This arrangement of the detection pattern ensures that the photo sensor 81 does not erroneously operate due to play of the date dial.

The following describes the second through sixth embodiments of the invention with reference to FIGS. 19 through 24.

Figure 19:
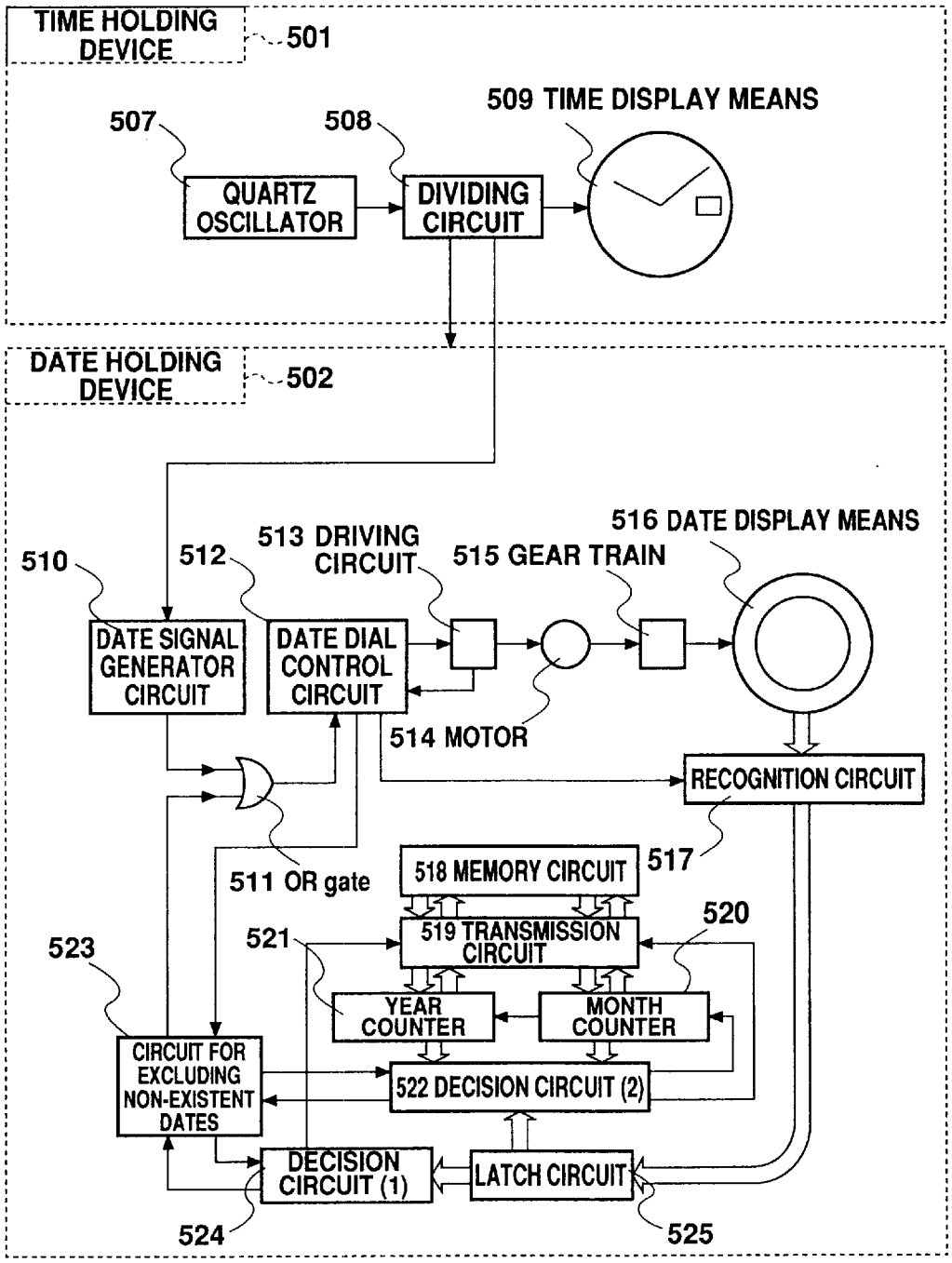
FIG. 19 is a block diagram illustrating an electronic timepiece practiced as a second embodiment of the invention.
Figure 24:
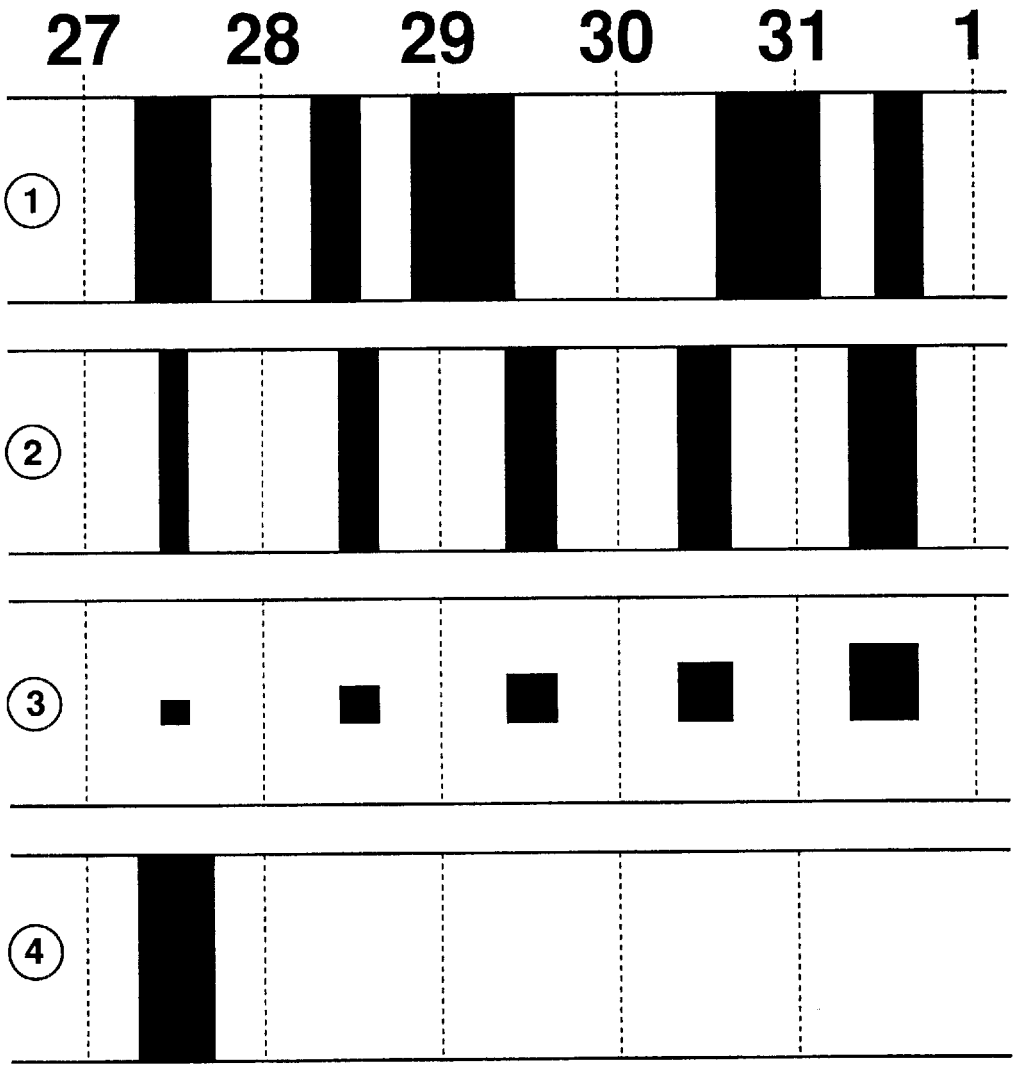
FIG. 24 is a pattern diagram illustrating another example of the pattern printed on the rear surface of the date display means according to the invention.

A time holding device 501 shown in FIG. 19 as a means for performing a general time counting operation converts a signal of 32768 Hz supplied from a quartz oscillator 507 into a signal of 1 Hz through a dividing circuit 508 to generates the reference signal for displaying time in an analog or digital manner. In addition to the 1 Hz signal, the dividing circuit 508 outputs daily a trigger signal for updating a date display means 516 printed with numerals 1 through 31. A date holding device 502 operates the date display means in a perpetual calendar manner and has a recognition circuit 517 for recognizing the current display day from the date display means 516 itself, controlling the time with which the date is set to 1 at the update of month on the basis of the day data obtained by the recognition circuit. The recognition of date is made by the barcode patterns (①, ②, and ③ in FIG. 24) correlated to the dates of the date display means 516, these barcode patterns being provided on the rear side opposite to the date display section. The pattern trains (①, ②, and ③ of FIG. 24 are each assigned with a different barcode-like pattern for discriminating each of the days 28 through 31. The current display day is recognized by the print width and reflectiveness obtained when a light beam is projected to these patterns. The data obtained by the recognition circuit 517 is held in a latch circuit 525. When, on the basis of the data held in this latch, it is recognized that date 28, 29, 30, 31, or 1 is displayed on or has passed the date display means 516, data of the years since the last leap year and data of the month are advanced to a year counter 521 and a month counter 520, respectively, through a transmission circuit 519. When the currently displayed date is found by a decision circuit (2) 522 to be a non-existent date, a circuit for excluding non-existent dates 523 feeds the date display means by one day, increments the month data and, if the year data is to be incremented, updates the year data to rewrite the memory circuit, a trigger signal to be inputted in a next-day signal generator 510 being put in the standby state.

It should be noted that the date controller 512 supplies a date feed signal to a driver circuit 513 through an OR gate 511 from the date signal generator 510 or the circuit for excluding no-existing dates 523 to rotate a motor 514, feeding the date display means 516 through a gear train 514.

Figure 20:
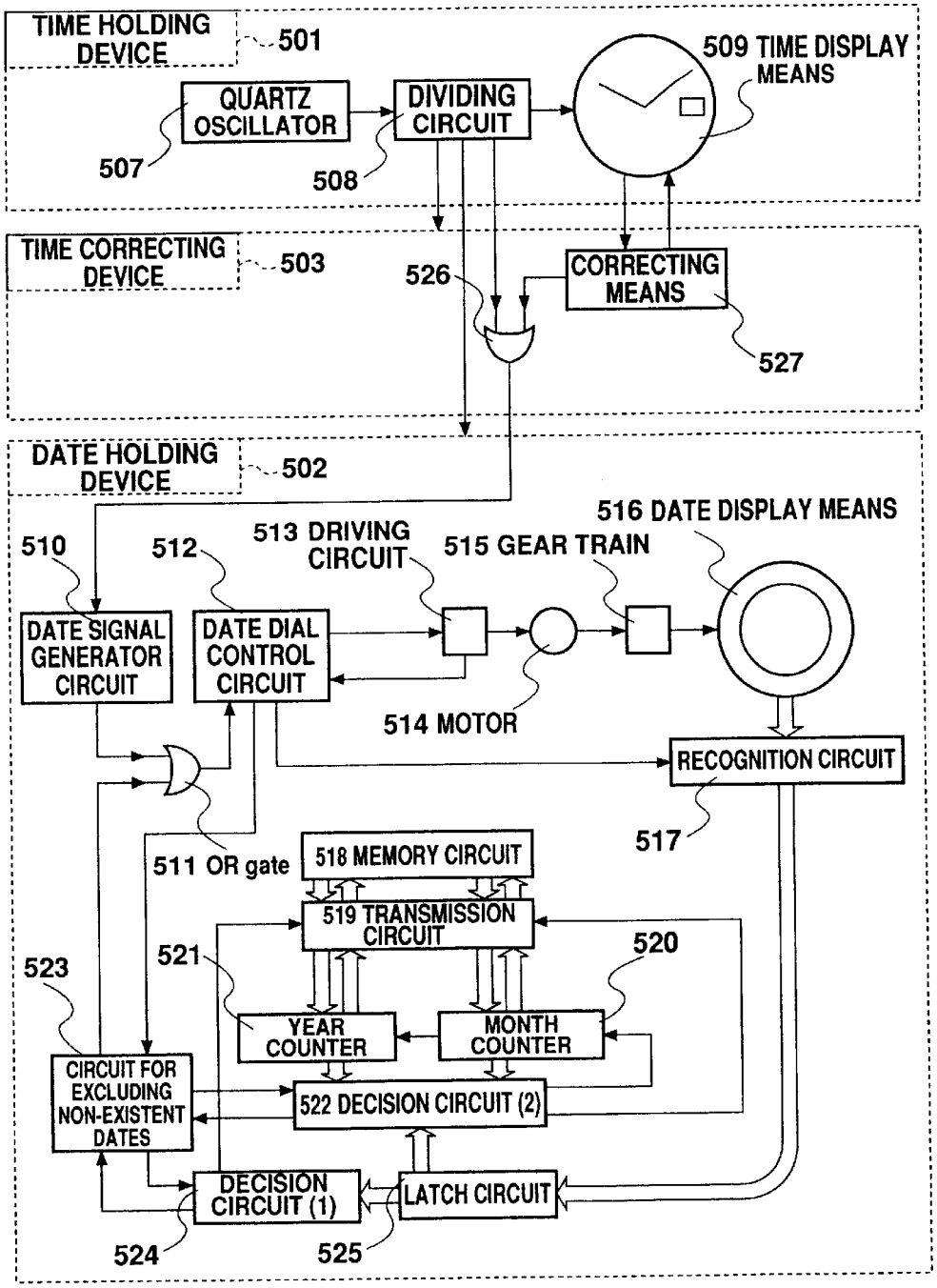
FIG. 20 is a block diagram illustrating an electronic timepiece practiced as a third embodiment of the invention.

FIG. 20 illustrates a configuration in which a time correcting device 503 is provided for externally setting as desired the contents of the time display means 509 shown in FIG. 19, such correction being made through a correcting means 527. The correcting means, in parallel to a date signal generally outputted from the divider every day, distributes the date signal such that the date display means is incremented or decremented by one day depending on the passing direction, thereby controlling the date holding device 502. The date at that time performs a perpetual calendar operation in forward and reverse rotations, which is controlled in the same manner as described with reference to the embodiment of FIG. 19.

Figure 21:
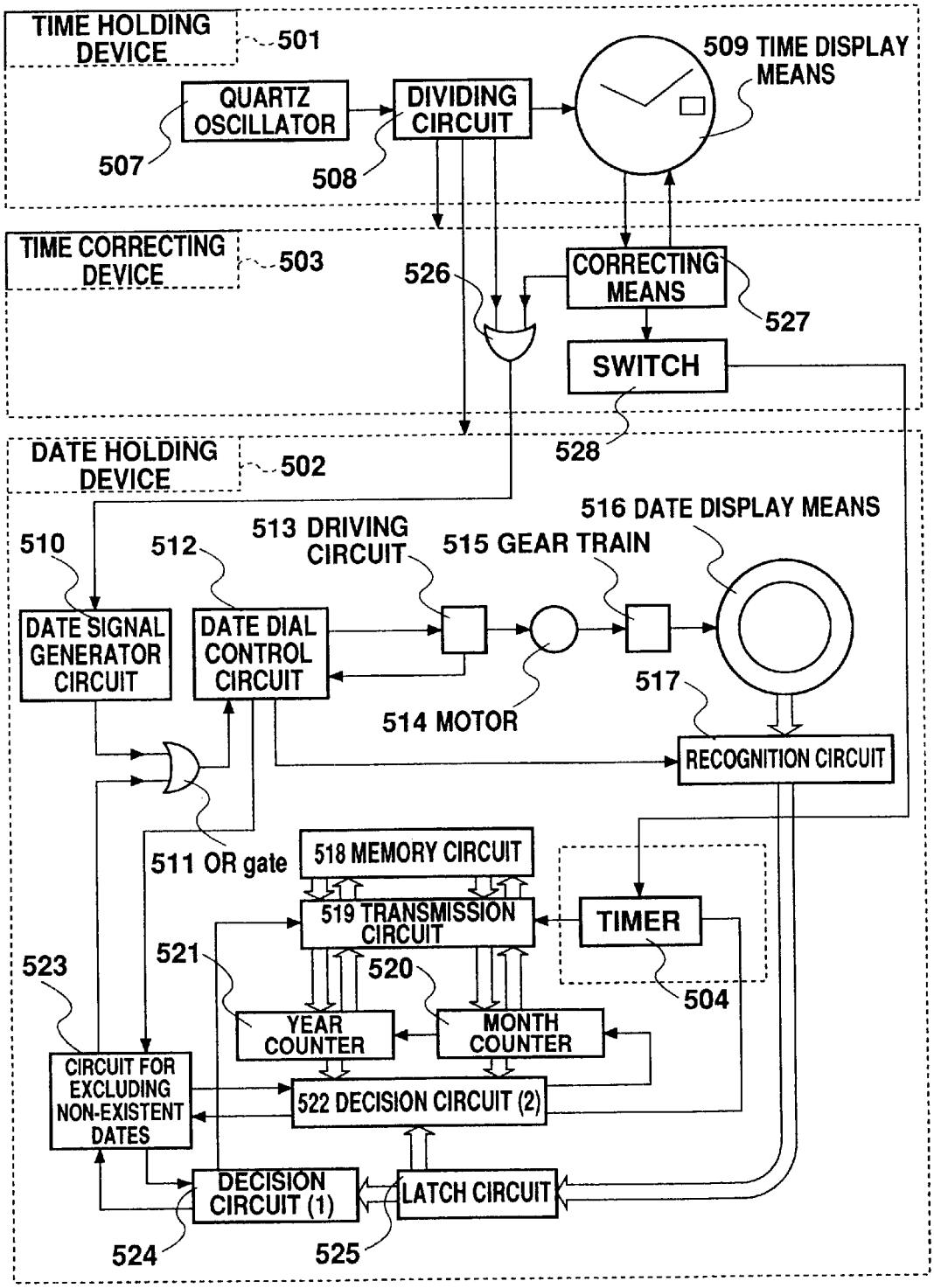
FIG. 21 is a block diagram illustrating an electronic timepiece practiced as a fourth embodiment of the invention.

FIG. 21 illustrates a configuration in which a switch 528 is provided to the time correcting device 503 of FIG. 20 for checking if a correcting operation is ready to be made by the correcting means 527. When the correcting means 527 is readying a correcting operation or when time difference correction is made, the year and month data may be updated frequently in a short period to rewrite the memory every time the update is made, thereby increasing the stress in the memory and the power dissipation for the memory rewrite operation.

Detecting that the time correcting means 527 is ready for time correction, the switch 528 activates a timer 504. The activated timer 504 enters the standby state without immediately rewriting the memory even if a memory circuit 518 becomes ready for rewriting by the decision circuit (2) 522. After a predetermined wait time, the timer begins rewriting the memory circuit 518.

If a date update operation is performed by the correcting means 527 in the memory rewrite standby state, the switch 528 resets the timer 504, after a predetermined time of which the memory circuit 518 is rewritten.

If the year and month data are updated frequently in a short period, the above-mentioned operation can reduce the number of times the memory circuit 518 is rewritten in a short period, thereby preventing the stress in the memory circuit 518 and the power dissipation by the rewriting from being increased.

Figure 22:
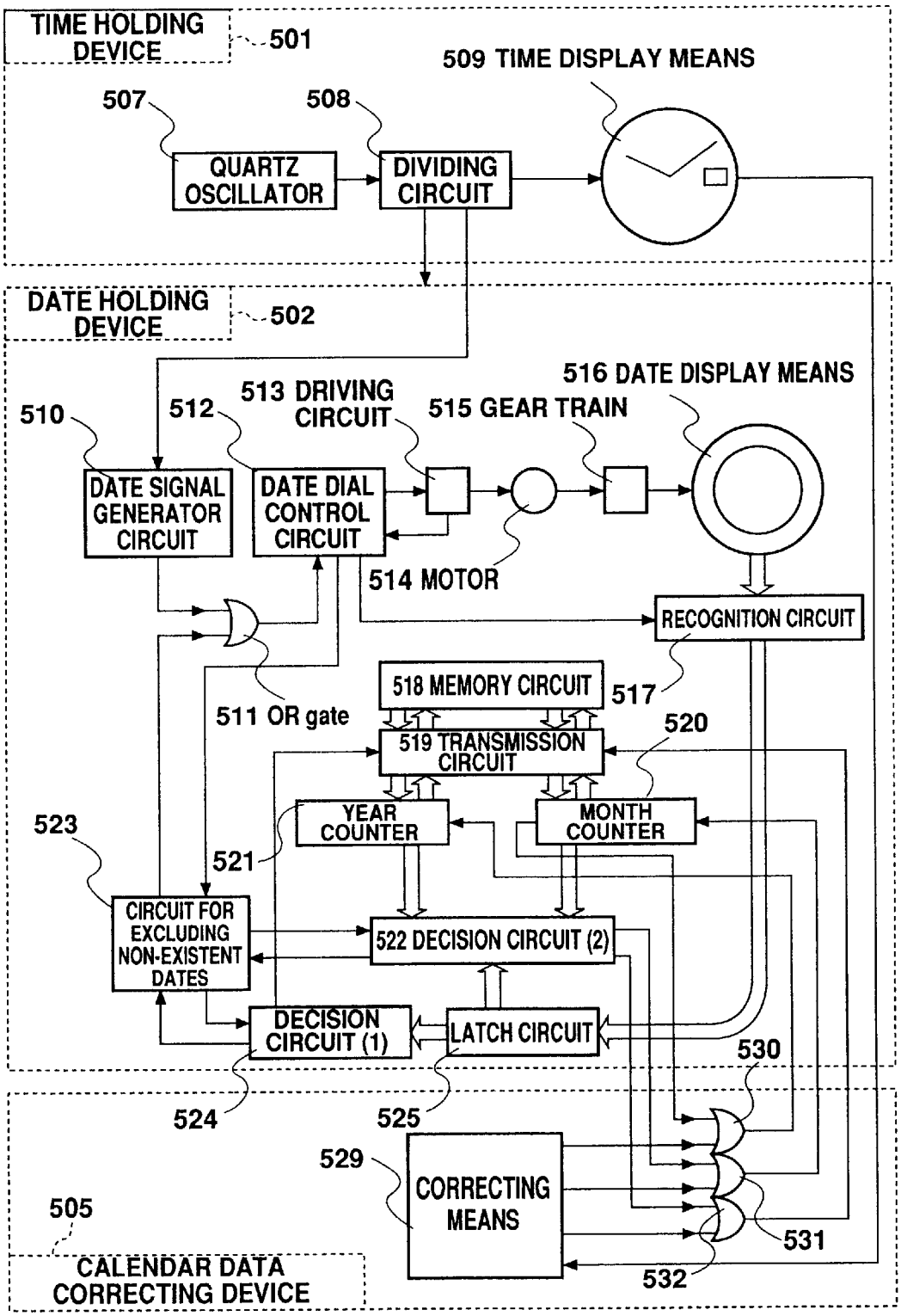
FIG. 22 is a block diagram illustrating an electronic timepiece practiced as a fifth embodiment of the invention.

FIG. 22 illustrates a configuration in which a year and month data correcting means 529 in the memory circuit 518 is provided to the above-mentioned configuration of FIG. 19. In the configuration of FIG. 22, year and month data are received from the outside by use of the coil of the drive motor in the time display means 509 as a reception antenna, the received data being temporarily stored in the correcting means 529.

The year data is sent from the correcting means 529 to the year counter 521 through an OR gate 530 and the month data to the month counter through an OR gate 531 and, at the same time, a memory rewrite signal is sent to a transmission circuit 519 through the OR gate 532, correcting the contents of the memory circuit 518.

The normal date update operation to be performed after passing of a predetermined time is the same as that described with reference to FIG. 19 except that the month data is sent from the decision circuit (2) 522 to the transmission circuit 519 through the OR gate 531 and the memory rewrite signal to the transmission circuit through the OR gate 532 and the a carry signal is sent from the month counter 520 to the year counter through the OR gate 530. Therefore, this date update operation will be described no further.

Figure 23:
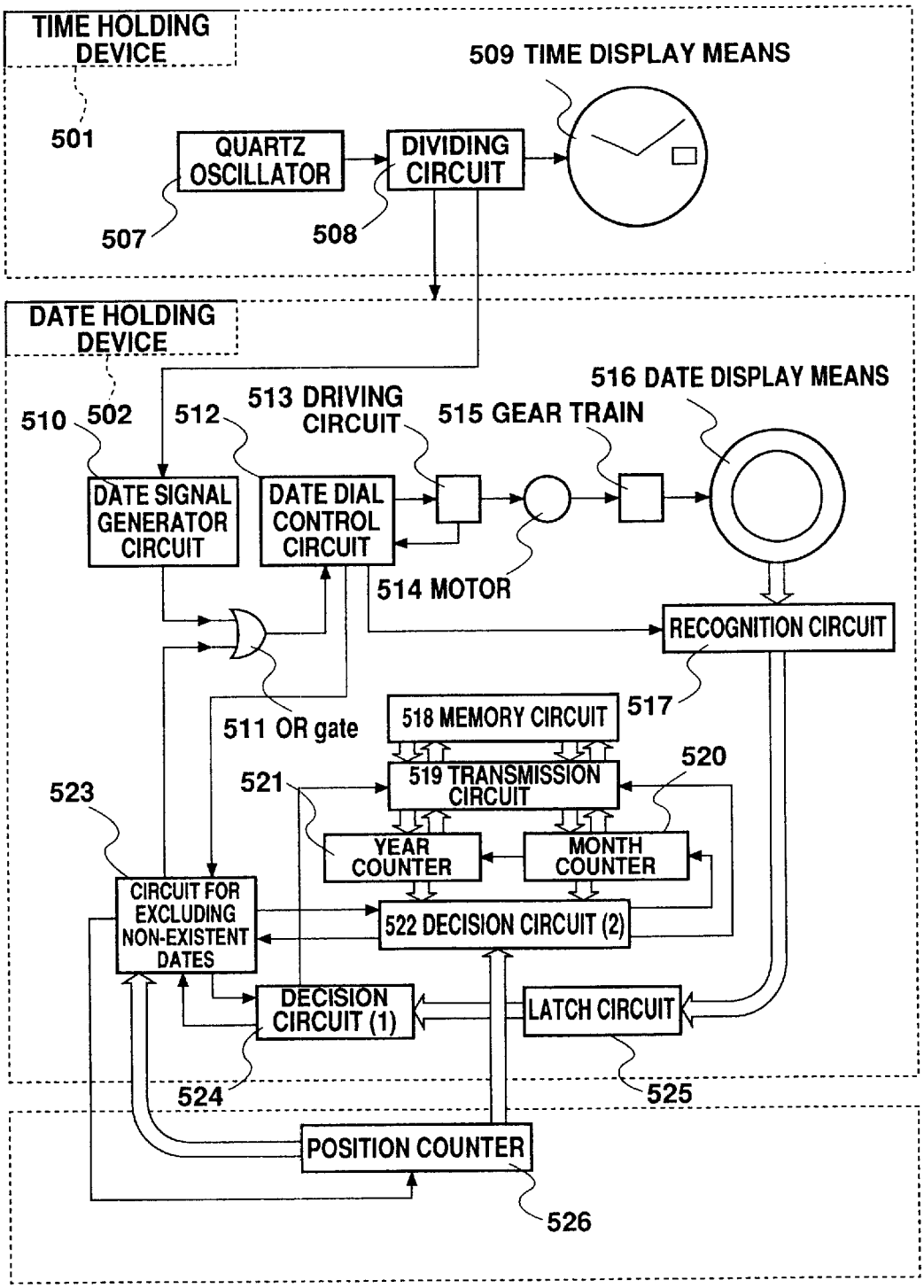
FIG. 23 is a block diagram illustrating an electronic timepiece practiced as a sixth embodiment of the invention.

FIG. 23 illustrates a configuration in which a means is provided for updating the year and month data by changing the print of the barcode-like pattern of the date display means for use in a perpetual calendar operation in FIG. 19 only at the position (④ in FIG. 24) corresponding to date 28, reading the number of shifted days from a position counter 526 by the decision circuit (2) 522, and, on the basis of this reading, the year and month data are updated with reference to the timing with which no-existing dates exclusion is performed.

In the embodiments shown in FIGS. 2 through 6, in order to make the date display be executed in a perpetual calendar manner, the display date is recognized by the pattern printed on the date display means and, only when date 28, 29, 30, or 31, which provides a month update timing, has been confirmed, the year and month data are read from the memory circuit. Based on this data, it is determined whether to perform no-existing dates exclusion or not. Based on this decision, the perpetual calendar operation is performed.

INDUSTRIAL APPLICABILITY

The electronic timepieces with the device for automatically adjusting month-end dates of calendar according to the present invention is useful in portable watches, table clocks, wall clocks, and other types of clocks.

What is claimed is:

1. An electronic timepiece having a device for automatically adjusting month-end dates of calendar comprising:

a power supply;

a quartz oscillator for generating a reference time signal;

time maintaining means for maintaining time on the basis of said time reference signal; and date display means operating on the basis of a signal from said time maintaining means, said timepiece further comprising:

recognition means for recognizing the display content of said date display means directly from said date display means;

a memory circuit for holding at least the month data; and control means for moving said date display means to day 1, which is the first day of each month, and instructing to execute the update operation of said memory circuit when said control means confirms that the output of said recognition means with respect to said month data is the end date of a month.

2. An electronic timepiece having a device for automatically adjusting month-end dates of calendar of claim 1, wherein said control means comprises:

a judging circuit for receiving an output from said recognition means;

a memory control circuit for controlling said memory circuit on the basis of the output from said judging circuit; and a date control circuit for outputting a drive signal to said date display means on the basis of the output from said judging circuit wherein said judging circuit controls said memory control circuit and said date control circuit on the basis of the outputs from said memory circuit and from said recognition means.

3. An electronic timepiece having a device for automatically adjusting month-end dates of calendar of claim 2, wherein said judging circuit includes a decoder circuit with a built-in perpetual calendar circuit.

4. An electronic timepiece having a device for automatically adjusting month-end dates of calendar according to any one of claims 1 through 3, wherein said memory circuit is constructed from a nonvolatile memory.

5. An electronic timepiece having a device for automatically adjusting month-end dates of calendar according to any one of claims 1 through 3, wherein said recognition circuit is a photo sensor mechanism.

6. An electronic timepiece having a device for automatically adjusting month-end dates of calendar of claim 5, further comprising a voltage detecting circuit for detecting the voltage condition of said power supply, wherein the sensitivity of said photo sensor mechanism is switched on the basis of the output from said voltage detecting circuit.

7. An electronic timepiece having a device for automatically adjusting month-end dates of calendar of claim 1, wherein said control means reads the data held in said memory circuit when the output of said recognition means is a particular date.

8. An electronic timepiece having a device for automatically adjusting month-end dates of calendar comprising: a power supply, a time holding device, and a date holding device, said time holding device having a quartz oscillator for generating a reference time, a dividing circuit for dividing the output of said quartz oscillator, and a time display means operating on the basis of the output of said dividing circuit, said date holding device having a date signal generator circuit operating on the basis of an output made every day from said dividing circuit, a date dial control circuit operating on the basis of an output from said date dial control circuit through a driving circuit, a gear train operated by said motor, a date display means operated by said gear train, a recognition circuit for recognizing a display content from said date display means, a latch circuit for holding an output from said recognition circuit, a decision circuit for operating a transmission circuit to read out contents of a memory circuit if a content held in said latch circuit is in a particular state, a year counter and a month counter in which the content of said memory circuit is held through said transmission circuit, a decision circuit 2 for determining whether the particular state held in said latch circuit is the end date of a month relative to said year counter and said month counter and, when said particular state is determined to be the end date, moving the date to day 1, which is the first day of each month, and updating said memory circuit, and a circuit for excluding no-existing dates for controlling said decision circuit 1, said decision circuit 2, and said date dial control circuit, wherein the data is read from said memory circuit only when a particular date from said date display means is detected.

9. The electronic timepiece having a device for automatically adjusting month-end dates of calendar as claimed in claim 8 further comprising: a time difference correcting device including a correcting means for intruding the output signal into said date signal generator circuit in parallel with the output from said dividing circuit.

10. The electronic timepiece having a device for automatically adjusting month-end dates of calendar as claimed in claim 9 wherein a switch is provided for determining whether said time difference correcting device is ready for operation, the data of said year counter and said month counter being transmitted to said memory circuit only when said switch is on, controlling a timing thereof through a timer.

11. The electronic timepiece having a device for automatically adjusting month-end dates of calendar as claimed in claim 9 or claim 10 wherein the update operation is performed only when a change is found in a calendar data state as compared with a previous state.

12. The electronic timepiece having a device for automatically adjusting month-end dates of calendar as claimed in claim 8 further comprising a correcting means for rewriting the year and month data stored in said memory circuit.

13. The electronic timepiece having a device for automatically adjusting month-end dates of calendar as claimed in claim 8 further comprising a position counter which operates in synchronization with the display content of said date display means, said position counter being reset when said date display means displays a certain position, counting the number of shift dates from the point of the resetting to exclude month-end non-existing dates.

* * * * *

UNITED STATES PATENT AND TRADEMARK OFFICE

CERTIFICATE OF CORRECTION

PATENT NO. : 6,385,136 B2
DATED : May 7, 2002
INVENTOR(S) : Haruhiko Higuchi et al.

It is certified that error appears in the above-identified patent and that said Letters Patent is hereby corrected as shown below:

Title page,
Item [62], Related U.S. Application Data, change "Division of application No. 09/380,133, filed on August 25, 1999," to -- Division of application No. 09/380,133, filed as application No. PCT/JP98/05903 on Dec. 25, 1998, now Pat. No. 6,278,661 --

Signed and Sealed this

Tenth Day of August, 2004

JON W. DUDAS
*Acting Director of the United States Patent and Trademark Office*